US011844408B2

(12) United States Patent
Kim et al.

(10) Patent No.: US 11,844,408 B2
(45) Date of Patent: Dec. 19, 2023

(54) DIFFUSER AND HAIR DRYER HAVING A DIFFUSER

(71) Applicant: LG ELECTRONICS INC., Seoul (KR)

(72) Inventors: Kyoungtae Kim, Seoul (KR); Hyunchul Kim, Seoul (KR); Yunhee Ku, Seoul (KR); Rayoung Park, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 531 days.

(21) Appl. No.: 17/077,915

(22) Filed: Oct. 22, 2020

(65) Prior Publication Data

US 2021/0315351 A1 Oct. 14, 2021

(30) Foreign Application Priority Data

Apr. 10, 2020 (KR) ..... 10-2020-0044034

(51) Int. Cl.
*A45D 20/12* (2006.01)
*A45D 20/26* (2006.01)

(52) U.S. Cl.
CPC ..... *A45D 20/122* (2013.01); *A45D 20/26* (2013.01); *A45D 2200/205* (2013.01)

(58) Field of Classification Search
CPC ..... A45D 20/122; A45D 20/26; A45D 2200/205; A45D 20/128
USPC ..... 34/95–100
See application file for complete search history.

(56) References Cited

U.S. PATENT DOCUMENTS

| | | | | |
|---|---|---|---|---|
| 939,106 | A | 11/1909 | Soles | |
| 2,560,808 | A | 7/1951 | MacCallum | |
| 3,265,075 | A | 8/1966 | Edman | |
| 5,275,339 | A | 1/1994 | Andis et al. | |
| 5,568,691 | A * | 10/1996 | Rubin | A45D 20/16 392/380 |
| 5,715,847 | A | 2/1998 | Rolf | |
| 6,070,597 | A | 6/2000 | Motherhead | |

(Continued)

FOREIGN PATENT DOCUMENTS

| | | |
|---|---|---|
| CN | 1167430 | 12/1997 |
| CN | 203884936 | 10/2014 |

(Continued)

OTHER PUBLICATIONS

Taiwanese Notice of Allowance dated Oct. 18, 2021 issued in TW Application No. 109136744.

(Continued)

*Primary Examiner* — Stephen M Gravini
(74) *Attorney, Agent, or Firm* — KED & ASSOCIATES

(57) ABSTRACT

A diffuser includes a diffusing case having a rear side removably coupled to a main body of a hair dryer. Gas discharged from the main body is introduced into the diffusing case through a gas inlet hole defined at the rear side. The gas introduced into the diffusing case is discharged from a front side of the diffusing case. The diffusing case has a concave or curved structure such that an inner diameter of the diffusing case increases in a forward direction. A guide frame provided inside the diffusing case to guide a flow of the introduced gas includes a diffusion portion or protrusion provided to face the gas inlet hole to diffuse the gas introduced through the gas inlet hole.

21 Claims, 10 Drawing Sheets

(56) References Cited

U.S. PATENT DOCUMENTS

| | | | | |
|---|---|---|---|---|
| D477,112 | S | 7/2003 | Yeung | |
| 6,601,316 | B2 | 8/2003 | Shaw, II | |
| 7,040,037 | B2 | 5/2006 | Keong | |
| 7,380,347 | B2 * | 6/2008 | Coats | A45D 20/12 34/97 |
| 7,946,056 | B2 | 5/2011 | Kroll | |
| 8,387,271 | B2 * | 3/2013 | Shami | A45D 20/12 132/211 |
| 8,434,238 | B2 * | 5/2013 | Gross | A45D 20/12 132/212 |
| 8,720,078 | B1 | 5/2014 | Behbehani | |
| 9,144,286 | B2 | 9/2015 | Courtney | |
| 9,498,039 | B2 * | 11/2016 | Matsui | A45D 20/12 |
| 9,839,274 | B1 * | 12/2017 | Brickner | H02J 7/35 |
| 9,936,788 | B2 | 4/2018 | Stephens et al. | |
| 10,165,843 | B2 | 1/2019 | Hedges | |
| 10,238,199 | B2 * | 3/2019 | Stephens | A45D 20/122 |
| 10,278,471 | B2 | 5/2019 | Shelton et al. | |
| 10,470,545 | B2 | 11/2019 | Thiebaut | |
| 10,610,001 | B2 | 4/2020 | Kim | |
| 10,660,418 | B2 | 5/2020 | deGrood et al. | |
| 10,702,037 | B2 * | 7/2020 | Boateng | A45D 2/001 |
| 10,869,529 | B2 | 12/2020 | Chia | |
| 10,874,186 | B2 | 12/2020 | MacPherson | |
| D935,688 | S | 11/2021 | Park | |
| 11,253,040 | B2 * | 2/2022 | Kim | F21V 3/00 |
| 11,425,979 | B2 * | 8/2022 | Conrad | F24H 3/0423 |
| 11,457,713 | B2 * | 10/2022 | Conrad | A45D 20/10 |
| 11,464,313 | B2 * | 10/2022 | Wang | A45D 20/12 |
| 11,576,474 | B2 * | 2/2023 | Kim | A45D 20/122 |
| 11,633,028 | B2 * | 4/2023 | Kim | A45D 20/122 34/97 |
| 2003/0079367 | A1 | 5/2003 | Troletti | |
| 2009/0000141 | A1 | 1/2009 | Gross et al. | |
| 2015/0007442 | A1 | 1/2015 | Gammack | |
| 2016/0367006 | A1 | 12/2016 | Stephens et al. | |
| 2016/0367008 | A1 | 12/2016 | Stephens et al. | |
| 2017/0105501 | A1 | 4/2017 | Palmer | |
| 2018/0036553 | A1 | 2/2018 | Shiibashi | |
| 2019/0014880 | A1 | 1/2019 | Degrood | |
| 2021/0315350 | A1 | 10/2021 | Kim | |
| 2021/0315351 | A1 * | 10/2021 | Kim | A45D 20/122 |
| 2021/0315353 | A1 | 10/2021 | Kim et al. | |
| 2021/0315354 | A1 | 10/2021 | Kim | |
| 2021/0315355 | A1 * | 10/2021 | Kim | A45D 20/122 |
| 2021/0315356 | A1 | 10/2021 | Kim | |
| 2022/0304444 | A1 | 9/2022 | Wang | |

FOREIGN PATENT DOCUMENTS

| | | |
|---|---|---|
| CN | 104273918 | 1/2015 |
| CN | 107529865 | 1/2018 |
| CN | 109247685 | 1/2019 |
| CN | 106539271 | 11/2019 |
| CN | 209732900 | 12/2019 |
| CN | 217013050 | 7/2022 |
| FR | 2766338 | 1/1999 |
| GB | 2612788 | 5/2023 |
| JP | 01-055803 | 4/1989 |
| JP | 2012-019865 | 2/2012 |
| JP | 2012-239535 | 12/2012 |
| JP | 2013-162830 | 8/2013 |
| JP | 2016-502432 | 1/2016 |
| JP | 2016-072174 | 5/2016 |
| JP | 2018-015539 | 2/2018 |
| JP | 6346700 | 6/2018 |
| JP | 2018-134441 | 8/2018 |
| JP | 2018-175726 | 11/2018 |
| JP | 3222699 | 8/2019 |
| KR | 20-1985-0002139 | 10/1985 |
| KR | 10-1997-0706745 | 12/1997 |
| KR | 20-1998-0026628 | 8/1998 |
| KR | 10-2001-0086200 | 9/2001 |
| KR | 10-2010-0066043 | 6/2010 |
| KR | 20-2011-0002484 | 3/2011 |
| KR | 10-1056026 | 8/2011 |
| KR | 10-1155135 | 6/2012 |
| KR | 20-0468263 | 8/2013 |
| KR | 20-2016-0002206 | 6/2016 |
| KR | 10-2016-0095646 | 8/2016 |
| KR | 10-2015-0023773 | 1/2017 |
| KR | 10-1758360 | 7/2017 |
| KR | 10-2017-0139520 | 12/2017 |
| KR | 10-2017-0138806 | 2/2018 |
| KR | 10-2018-0017193 | 2/2018 |
| KR | 10-1872227 | 6/2018 |
| KR | 20-2018-0003263 | 11/2018 |
| KR | 10-2018-0130756 | 12/2018 |
| KR | 10-1928531 | 12/2018 |
| KR | 10-2019-0072169 | 6/2019 |
| KR | 10-1988303 | 6/2019 |
| KR | 10-2019-0084801 | 7/2019 |
| KR | 10-2020-0033086 | 3/2020 |
| KR | 10-2020-0033115 | 3/2020 |
| TW | 201914475 | 4/2019 |
| TW | 201914476 | 4/2019 |
| TW | 201936080 | 9/2019 |
| WO | WO 2011/100711 | 8/2011 |
| WO | WO 2020/165554 | 8/2020 |
| WO | WO 2021/090155 | 5/2021 |

OTHER PUBLICATIONS

Korean Notice of Allowance dated Nov. 16, 2021 issued in KR Application No. 10-2020-0044040.

Korean Notice of Allowance dated Nov. 18, 2021 issued in KR Application No. 10-2020-0044038.

U.S. Office Action dated Apr. 6, 2023 issued in U.S. Appl. No. 17/077,927.

U.S. Office Action dated Sep. 23, 2022 issued in U.S. Appl. No. 17/077,917.

International Search Report issued in Application No. PCT/KR2020/012282 dated Jul. 22, 2021.

International Search Report issued in Application No. PCT/KR2020/012288 dated Jul. 26, 2021.

U.S. Office Action dated Jul. 20, 2022 issued in U.S. Appl. No. 17/077,929.

Taiwanese Notice of Allowance dated Apr. 28, 2022 issued in Application No. 109137300 (English translation attached).

U.S. Office Action dated Jul. 27, 2022 issued in U.S. Appl. No. 17/077,922.

Taiwanese Notice of Allowance dated Jan. 5, 2022 issued in Application No. 109136741 (English translation attached).

U.S. Appl. No. 17/077,915, filed Oct. 22, 2020.

U.S. Appl. No. 17/077,917, filed Oct. 22, 2020.

U.S. Appl. No. 17/077,921, filed Oct. 22, 2020.

U.S. Appl. No. 17/077,922, filed Oct. 22, 2020.

U.S. Appl. No. 17/077,927, filed Oct. 22, 2020.

U.S. Appl. No. 17/077,929, filed Oct. 22, 2020.

U.S. Appl. No. 17/085,385, filed Oct. 30, 2020.

U.S. Appl. No. 17/077,119, filed Oct. 22, 2020.

International Search Report issued in Application No. PCT/KR2020/012272 dated Jul. 22, 2021.

International Search Report issued in Application No. PCT/KR2020/012273 dated Jul. 22, 2021.

International Search Report issued in Application No. PCT/KR2020/012284 dated Jul. 22, 2021.

International Search Report issued in Application No. PCT/KR2020/012286 dated Jul. 22, 2021.

International Search Report issued in Application No. PCT/KR2020/012292 dated Jul. 22, 2021.

International Search Report issued in Application No. PCT/KR2020/012289 dated Jul. 27, 2021.

Korean Office Action issued in Application No. 10-2020-0044041 dated Aug. 6, 2021.

Taiwan Office Action issued in Application No. 109137300 dated Aug. 13, 2021.

(56) References Cited

OTHER PUBLICATIONS

Taiwan Office Action issued in Application No. 109136742 dated Aug. 13, 2021.
Taiwan Office Action issued in Application No. 109136743 dated Aug. 13, 2021.
Taiwan Office Action issued in Application No. 109136745 dated Aug. 13, 2021.
United States Office Action dated Apr. 25, 2022 issued in co-pending related U.S. Appl. No. 17/077,917.
United States Office Action dated Apr. 26, 2022 issued in co-pending related U.S. Appl. No. 17/077,921.
United States Notice of Allowance dated Oct. 12, 2022 issued in co-pending related U.S. Appl. No. 17/077,921.
U.S. Office Action dated Aug. 31, 2023 issued in U.S. Appl. No. 17/077,119.

* cited by examiner

DIFFUSER AND HAIR DRYER HAVING A DIFFUSER

CROSS-REFERENCE TO RELATED APPLICATION

This application claims priority under 35 U.S.C. § 119 to Korean Application No. 10-2020-0044034, filed on Apr. 10, 2020, whose entire disclosure is hereby incorporated by reference.

BACKGROUND

1. Field

The present disclosure relates to a diffuser and a hair dryer including a diffuser.

2. Background

When removing moisture from wet hair or when styling hair, a hair dryer that discharges gas through a gas outlet may be used. In one example, the hair dryer may provide air or gas having certain characteristics desired by a user, such as a desired gas temperature, a desired gas speed, and a desired gas flow shape or area, through a diffuser. The diffuser may be coupled to a main body of the hair dryer to change the gas characteristics. Further, the diffuser may include a care device such as massage protrusions or bristles to manage scalp health and the like.

Korean Utility Model Application Publication No. 20-2011-0002484 discloses a diffuser provided in a hair dryer. The diffuser may be different from a gas outlet of the hair dryer in a cross-sectional area through which discharged gas flows or a speed of the discharged gas. It is important for the diffuser to efficiently discharge air or gas while sufficiently caring for a scalp or in facilitating hair styling.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
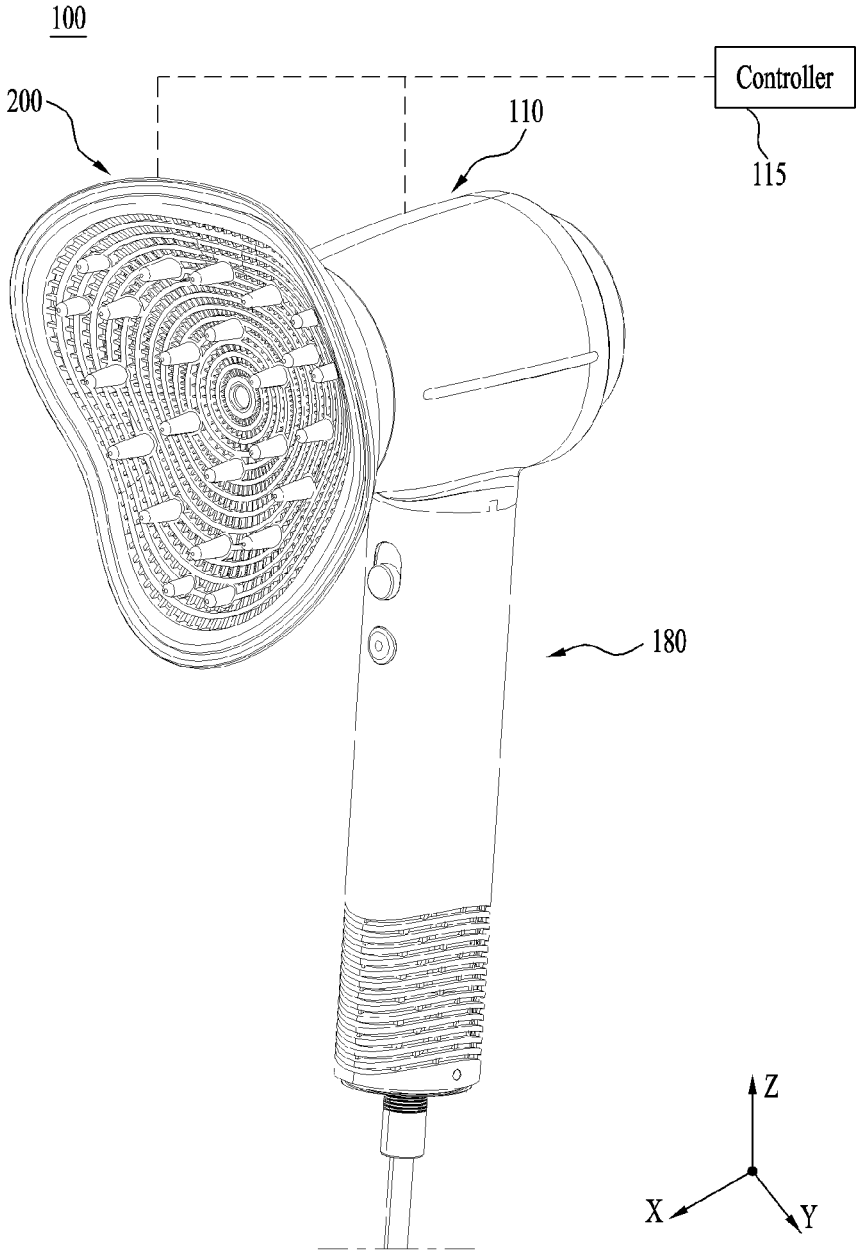
FIG. 1 is a view showing a hair dryer according to an embodiment.
Figure 2:
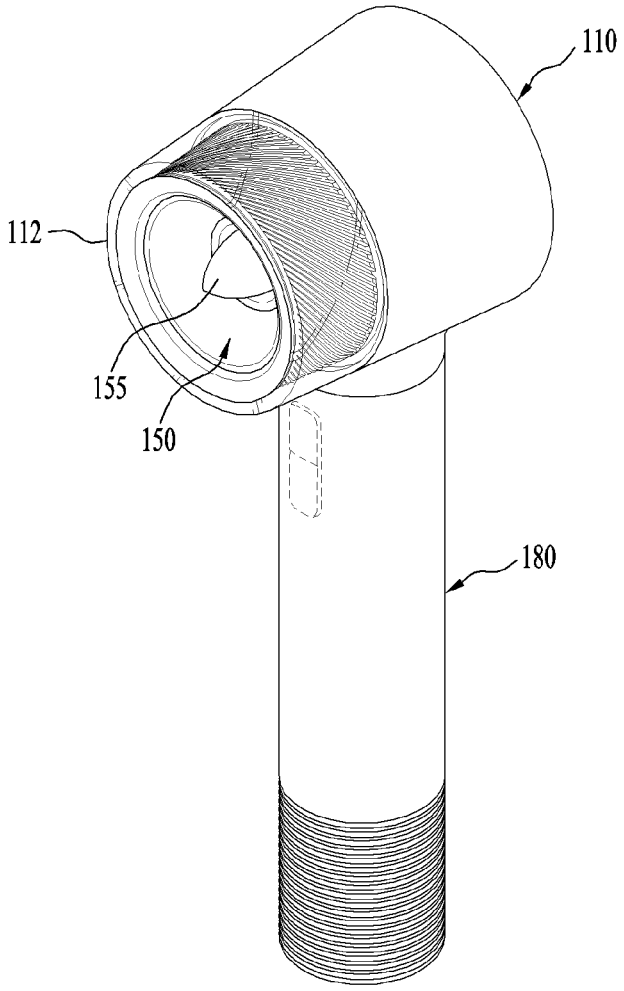
FIG. 2 is a view showing a state in which a diffuser is separated from the hair dryer shown in FIG. 1.
Figure 3:
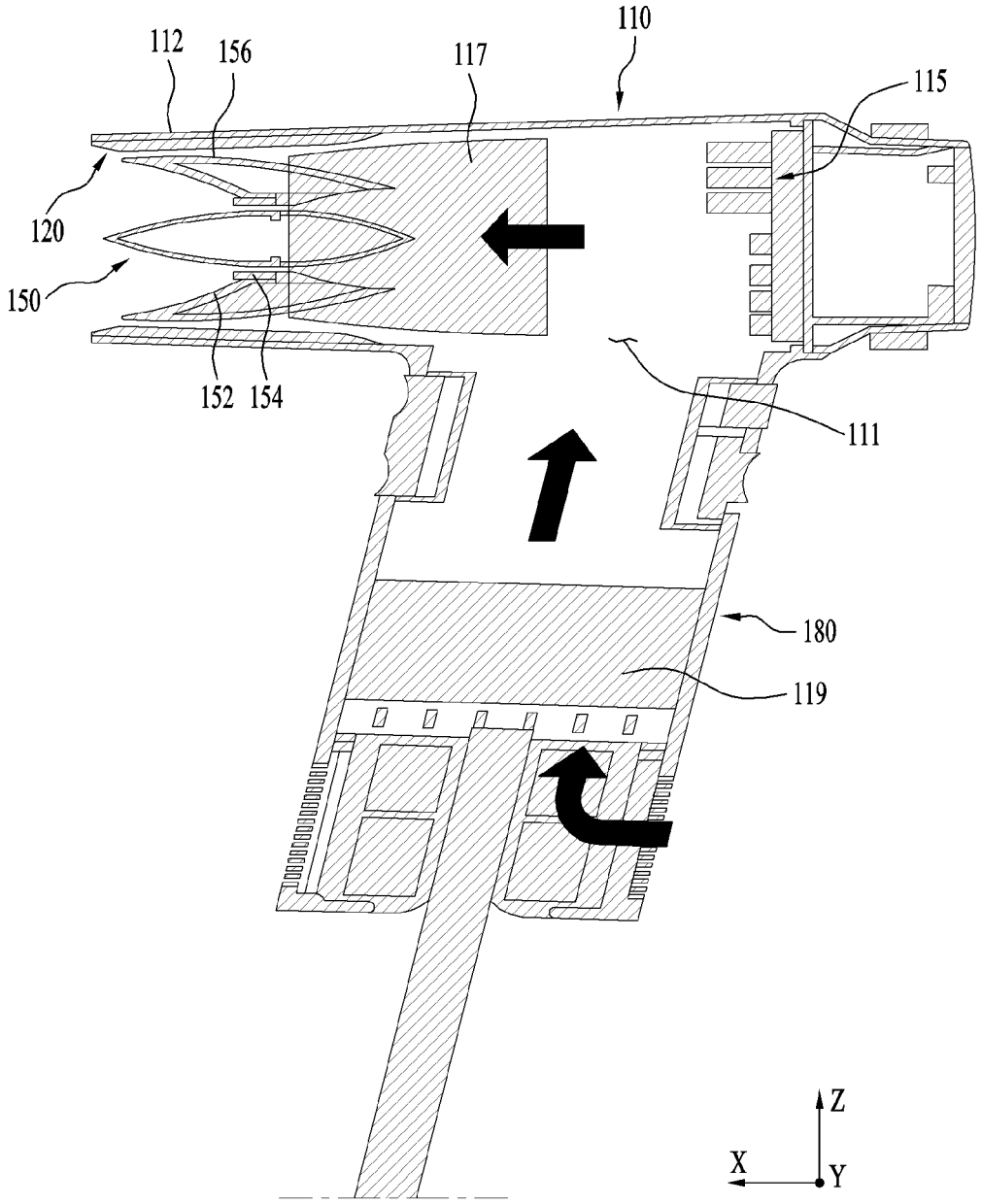
FIG. 3 is a view showing an internal cross-section of the hair dryer shown in FIG. 2.

Referring to FIGS. 1-3, a hair dryer 100 according to an embodiment may include a main body 110, a handle 180, and a diffuser 200 as shown in FIG. 1. In addition, as shown in FIG. 2, the main body 110 may include a gas or air outlet 150 through which gas or air introduced from outside is discharged.

As shown in FIG. 3, the main body 110 may include a gas or air flow path 111 through which the introduced gas flows. The gas inside of the gas flow path 111 may be discharged through the gas outlet 150 to the outside. The main body 110 may have an extended shape along a front-rear direction and may have various cross-sectional shapes such as circular, elliptical, stadium, or polygonal shapes when viewed from the front.

In the present disclosure, front, rear, left, right, top, and bottom definitions may be made centering on the main body 110. Referring to FIG. 2, the gas outlet 150 may be provided at a front side of the main body 110, and the handle 180 may have a shape extending substantially downward from the main body 110.

The gas flowing inside the main body 110 may be introduced through a gas inlet, which may be provided on the handle 180 (as shown in FIG. 3) or alternatively on the main body 110 (for example, at a rear of the main body 110). As shown in FIGS. 1 to 3, when the gas inlet is provided on the handle 180, the gas flow path 111 may extend from gas inlet formed in the handle 180 toward the gas outlet 150 of the main body 110, or upward and frontward. The gas may be introduced or suctioned from the outside through the gas inlet, and the introduced gas may flow along the gas flow path 111 and be discharged to the outside through the gas outlet 150.

The handle 180 may be a portion of the hair dryer 100 grabbed by a hand of a user, and may have a shape that improves grip convenience. The handle 180 may extend downward from the main body 110, as illustrated in FIGS. 1 to 3, but embodiments disclosed herein are not limited to a downward handle 180. The handle 180 may be integrally molded with the main body 110, or separately manufactured from the main body 110 and later coupled to the main body 110.

When the handle 180 is manufactured separately from the main body 110 and later coupled to the main body 110, the handle 180 may be provided such that a longitudinal direction thereof with respect to the main body 110 is fixed or variable. For example, the handle 180 may have a hinge coupling portion or hinge structure, and may be coupled to the main body 110 such that the longitudinal direction of the handle 180 is changeable (e.g., foldable) relative to the main body 110 so as to make grasping and/or styling convenient.

The extending direction of the handle 180 may vary. However, for convenience of description below, the direction in which the handle 180 extends from the main body 110 will be described as a downward direction.

Referring to FIG. 3, the hair dryer 100 according to an embodiment may include a fan 119 capable of moving (e.g., suctioning and/or discharging) gas or air and adjusting a speed of the gas or air discharged through the gas outlet 150. The fan 119 may be provided in the gas flow path 111 to blow the gas. The fan 119 may be provided inside the handle 180 (as illustrated) or alternatively inside of the main body 110 (e.g., a rear of the main body 110).

The fan 119 may be provided near or adjacent to the gas inlet. For example, when the gas inlet is provided in the handle 180, the gas flow path 111 may extend from the gas inlet of the handle 180 to the gas outlet 150, and the fan 119 may be provided in a portion of the gas flow path 111 located in the handle 180.

A temperature adjuster 117 (e.g., a heater or cooler) may be provided inside of the main body 110 (or alternatively, the handle 180) to adjust a temperature of the discharged gas. The temperature adjuster 117 may be provided in various forms and may be provided at various positions. In FIG. 2, the temperature adjuster 117 is provided inside the main body 110.

In addition, the temperature adjuster 117 may be provided in various types. The temperature adjuster 117 may use a heating scheme by providing current to a coil-shaped resistor to generate heat. However, the resistor of the temperature adjuster 117 may not necessarily be in the shape of the coil, and may be provided in various types, such as a thermoelement capable of heating the gas or adjusting the temperature of the gas. As another example, the temperature adjuster 117 may include a thermoelectric cooler (TEC) or Peltier device to provide cool air.

A method for operating the hair dryer 100 according to an embodiment of the present disclosure will be schematically described with respect to gas or air flow.

First, the user may manipulate or operate a power button provided on the main body 110 or the handle 180. When the power button is turned on, the fan 119 may be operated, and gas may be introduced or suctioned into the hair dryer 100.

The gas introduced through the gas inlet flows along the gas flow path 111 via the fan 119 toward the gas outlet 150, and the gas is discharged through the gas outlet 150 to the user. In this process, a flow speed of the gas along the gas flow path 111 may be adjusted by the fan 119, and a temperature of the gas flowing along the gas flow path 111 may be adjusted by the temperature adjuster 117.

In one example, the hair dryer 100 according to an embodiment may include a controller 115. The controller 115 may be connected not only to the fan 119, the temperature adjuster 117, the power button, and a manipulator or user interface to select a desired temperature or flow speed, but also to a light irradiator or light 260 (FIG. 6), a proximity sensor 269 (FIG. 6), a moisture measurement protrusion or sensor 312 (FIG. 6), and the like, which may be provided on the diffuser 200 and to be described later. The controller 115 may control the above described components.

The controller 115 may be provided on one of the diffuser 200, the main body 110, or the handle 180. Alternatively, a plurality of controllers 115 may be respectively arranged on all of the diffuser 200, the main body 110, and the handle 180. As indicated in FIG. 3, the controller 115 may be provided on the main body 110 to be signally connected to the diffuser 200, or, as indicated by the dotted lines in FIG. 1, a plurality of controllers 115 may be respectively arranged on the diffuser 200 and the main body 110.

Figure 6:
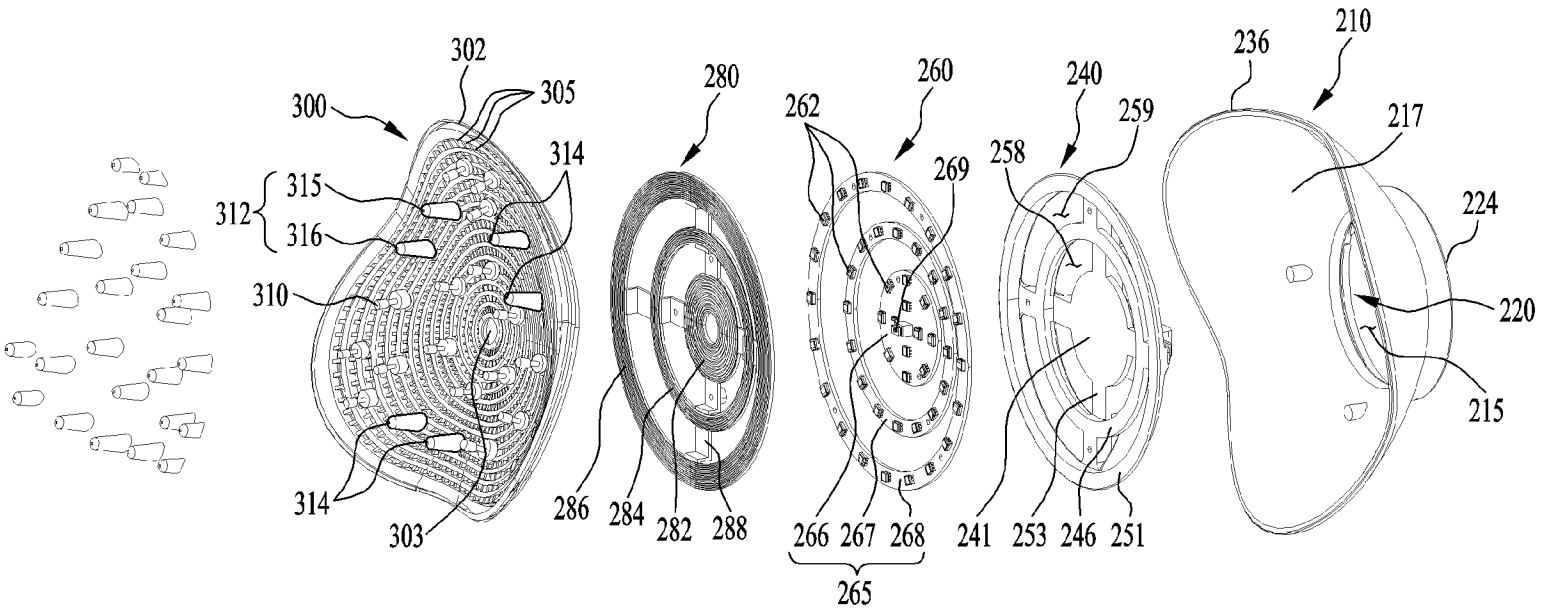
FIG. 6 is a view showing an exploded view of a diffuser according to an embodiment.

Adjusting operating states of the fan 119 and the temperature adjuster 117 may be performed by manipulation of the manipulator or user interface by the user or may be automatically performed based on an operation mode preset or predetermined in the controller 115. In addition, when a distance to a target located in front of the diffuser 200 is identified to be equal to or less than a reference or predetermined distance through the proximity sensor 269 of the diffuser 200, the controller 115 may control the light irradiator 260 of the diffuser 200 to irradiate light (FIG. 6).

The controller 115 may identify an impedance of the target located in front of the diffuser 200 through the moisture measurement protrusion 312 of the diffuser 200, and determine a moisture amount of the target through the impedance. As the moisture amount increases, the controller 115 may control the fan 119 such that the speed of the gas discharged through the gas outlet 150 increases, control the temperature adjuster 117 such that the gas temperature increases, or control the light irradiator 260 such that a light amount of the light irradiator 260 increases.

As shown in FIG. 1 or 3, the main body 110, where the gas outlet 150 is provided, may have a cross-section in an approximately circular shape and may have a front-rear length that is longer than a left-right width or diameter of the cross-section. However, the cross-section shape of the main body 110 may be varied as needed.

Figure 4:
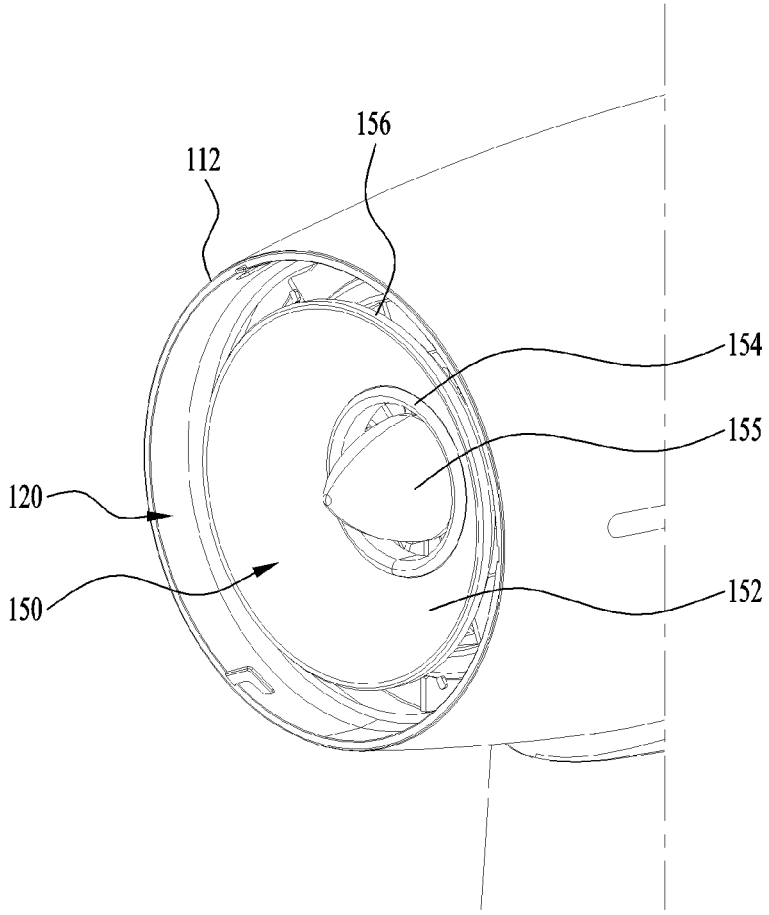
FIG. 4 is a view showing a gas outlet of a hair dryer according to an embodiment.

The gas outlet 150 of the hair dryer 100 according to an embodiment of the present disclosure will be described in detail with reference to FIG. 3. At least a portion of the gas flow path 111 may be defined inside the main body 110, and at least one side of the main body 110 may be opened or have an opening. For example, the main body 110 may extend in the front and rear direction, and a front surface thereof may be opened at a front end 112 (FIG. 4). The front end 112 may be a wall or front rim defining a front opening. The front opening of the main body 110 may be in communication with the gas flow path 111. The gas outlet 150 may be defined by an inner rim or surface of the front end 112. The front opening of the main body 110 may correspond to an end of the gas flow path 111, and the end of the gas flow path 111 may correspond to the gas outlet 150.

Referring to FIG. 4, in one example, the gas outlet 150 may include a discharge base or disc 152, which may be provided at the front opening of the main body 110. The discharge base 152 may be concentric with or provided inside of the front end 112. An outer edge of the discharge base 152 may be spaced apart from the front end 112 to define a side portion or opening 156 therebetween. The discharge base may have a center portion or opening 154. Gas may be discharged through the side and center openings 154 and 156, which may alternatively be referred to as outer and inner openings. The gas flowing along the gas flow path 111 may be simultaneously delivered to the center opening 154 and the side opening 156 to be discharged to the outside.

The center opening 154 and the side opening 156 may correspond to discharge holes through which the gas is discharged from the gas outlet 150. The center opening 154 may be defined at a central side on the cross-section of the gas outlet 150, and a cross-sectional shape thereof may be circular. However, embodiments disclosed herein are not limited to circular cross-sections, and a shape of the center opening 154 may be a polygonal shape such as a square as needed, and a size of a diameter, width, or cross-sectional area thereof may also be varied as needed.

The side opening 156 may surround the center opening 154. For example, as shown in FIG. 4, the center opening 154 may be defined in a substantially circular shape at the center of the discharge base 152 and/or a center of the entire gas outlet 150, and the side opening 156 may be an opening in a shape of a ring surrounding the discharge base 152. The ring shape may have an extended shape and/or a closed curve shape. For example, FIG. 4 discloses the side opening 156 having a circular ring shape. However, the ring shape of the side opening 156 may not necessarily be circular, and may be, for example, a polygonal ring shape such as a triangle or a square.

An optional guide cone 155 may be provided inside of the center opening 154 such that gas flows through a ring-shaped opening defined between, on the one hand, an inner side of the discharge base 152 defining the center opening 154, and, on the other hand, an outer surface of the guide cone 155. Details of the discharge base 152 and guide cone 155 will be described later. Like the shape of the side opening 156, the shape of the portion of the center opening 154 outside of the guide cone 155 is not limited to a circular ring shape, and may be, for example, a polygonal ring shape such as a triangle or a square.

The center opening 154 and the side opening 156 may be in communication with a same portion of the gas flow path 111. The center opening 154 may be concentric with the side opening 156.

A cross-sectional area of the entirety of the discharged gas may correspond to a size of an entire cross-section formed by the front end 112. However, The discharge base 152 may block a portion of the gas flowing through the gas outlet 150. The discharged gas may be diffused while flowing through the side opening 156, and a portion of the gas flow may be distributed toward a center of the cross-section where the gas is not discharged (i.e., toward the discharge base 152), and thus, the cross-sectional area of the discharge gas may be reduced.

Accordingly, the center opening 154 may be defined at a center of the side opening 156, and the gas of the side opening 156 that is distributed toward the center of the discharge base 152 may be suppressed by gas discharged through the center opening 154. The gas flowing through the center opening 154 may be radially dispersed and suppress the gas flowing through the side opening 156 and prevent the gas flowing through the side opening 156 from being distributed toward the center of the gas outlet 150, so that it may be advantageous for the entire discharged gas to maintain an initial cross-sectional area thereof.

Gas flowing through the center and side openings 54 and 156 may have a large cross-sectional area, facilitating a drying process. For example, an entire volume of gas discharged through the center opening 154 and the side opening 156 may be sufficient to allow the user to dry a larger area.

Since the center opening 154 and the side opening 156 may be in communication with the same cross-sectional area of the gas flow path 111, there may not necessarily be separate gas flow paths 111 for the center opening 154 and the side opening 156. Thus, provided three-dimensional gas discharge to the user may be efficient.

The center opening 154 may be defined at a center of the discharge base 152, and the side opening 156 may be defined between an outer circumferential surface of the discharge base 152 and the front end 112 of the main body 110, which may be a wall or rim defining the front opening.

The discharge base 152 may be coupled to the front end 112 of the main body 110 and may have a same cross-sectional shape of the front opening, but embodiments disclosed herein are not be limited thereto and may be formed in various shapes or materials. For example, the discharge base 152 may be provided to be partially different from the shape of the front opening of the main body 110 to determine the shape of the side opening 156, and may be molded with a material that is the same as or different from a material of the front end 112 or outer wall of the main body 110.

The discharge base 152 may constitute an entirety or a portion of one surface (e.g., the front surface) of the main body 11, so that the center opening 154 may be defined at the center of the discharge base 152, and the side opening 156 may be defined between the outer circumferential surface of the discharge base 152 and the front end 112 of the main body 110.

The discharge base 152 may be coupled to an opening of the main body 110 in various schemes, such as a scheme using a plurality of coupling ribs and/or may be integrally molded with the main body 110.

In one example, as shown in FIG. 4, the discharge base 152 may be indented or recessed toward an interior of the main body 110 from the front end 112 such that a front rim of the front end 112 protrudes further forward than a front surface of the discharge base 152.

Furthermore, a center of the front surface of the discharge base 152 may be indented or recessed toward the interior of the main body 110 such that the front surface of the discharge base 152 may form a curved or bent surface. Accordingly, the gas discharged through the center opening 154 may be discharged upstream or before the gas discharged through the side opening 156.

When the gas discharged through the center opening 154 starts to be diffused prior to the gas discharged through the side opening 156, the cross-sectional area of the gas discharged through the central opening 154 may be increased through diffusion, and may suppress a flow of the gas discharged through the side opening 156 toward a center. Further, a curvature of the curved surface of the front surface of the discharge base 152 may be variously set as necessary to prevent or reduce turbulence.

A guide cone 155 may be provided at a center of the center opening 154 to guide a flow of the gas discharged through the center opening 154. The gas may be discharged between an inner surface of the center opening 154 and the guide cone 155.

FIG. 4 illustrates the guide cone 155 provided at the center of the center opening 154. As the guide cone 155 is provided, the gas flowing through the center opening 154 is discharged into a space between the inner surface of the center opening 154 and an outer surface of the guide cone 155.

When the guide cone 155 is provided at the center of the center opening 154, the gas may flow through an outer portion of the center opening 154, which may be a ring-shaped discharge hole. The gas discharged through the center opening 154 may have a ring-shaped cross-section.

The gas discharged through the center opening 154 may contribute to suppressing a reduction of a cross-sectional area of the gas discharged through the side opening 156 by blocking some gas discharged through the side opening 156 from flowing toward inward toward a center in the flow process. In addition, the guide cone 155 may increase a level or speed at which the gas discharged through the center opening 154 diffuses outward.

When the cross-sectional area of the gas discharged through the center opening 154 is increased due to the guide cone 155, the suppression of inward flow of gas discharged through the side opening 156 may be increased.

In one example, in the guide cone 155, a rear end protruding toward the gas flow path 111 and a front end protruding in a discharge direction of the gas of the center opening 154 may respectively have conical shapes. The conical shape may mean a shape in which a cross-sectional area has a circular or elliptical shape, and where a diameter or width of the circle gradually decreases as a length increases.

However, in the conical shape, the circular shape of the cross-sectional area is not limited to perfect circles and may have, for example an ellipse or stadium shape. Furthermore, a reduction in the diameter may not necessarily be constant; for example, a diameter reduction rate may gradually increase or gradually decrease.

As the front end of the guide cone 155 protrudes in the conical shape, the gas discharged through the center opening 154 may be increasingly concentrated toward a rim of the center opening 154. Thus, a flow of the gas discharged through the side opening 156 and flowing toward the center opening 154 may be further suppressed.

An outer circumferential surface of the guide cone 155 may have a shape or size corresponding to an inner circumferential surface of the center opening 154, and a separation distance between the outer circumferential surface of the guide cone 155 and the inner circumferential surface of the center opening 154 may be varied as needed. Further, the guide cone 155 may be made of a material the same as or different from the material of the discharge base 152, and a curvature of the outer surface thereof may be variously designed as needed.

In one example, the gas outlet 150 may further include a discharge guide ring. The discharge guide ring may be provided on the inner surface of the center opening 154 and protrude in the discharge direction of the gas discharged through the center opening 154 to guide the gas flow together with the guide cone 155. FIG. 4 illustrates that the guide cone 155 and the discharge guide ring may be arranged in the center opening 154.

The discharge guide ring may have a ring shape extending along the rim of the center opening 154, and may be integrally molded with the discharge base 152 or molded separately from the discharge base 152 to be later coupled to the inner circumferential surface of the center opening 154.

The discharge guide ring may protrude outward or forward and rearward from the center opening 154 or the discharge base 152 and/or protrude based on the gas discharge direction. The flow of the gas through the center opening 154 may be concentrated between the guide cone 155 and the discharge guide ring by the guide cone 155 and the discharge guide ring protruding from the center opening 154. A protruding end of the discharge guide ring may have a curved shape to facilitate the gas flow. A diameter of the discharge guide ring may be different for each portion, and a shape thereof may also be varied as needed. The front end 112 of the main body 110 may include a first coupling member 120 described later.

Figure 5:
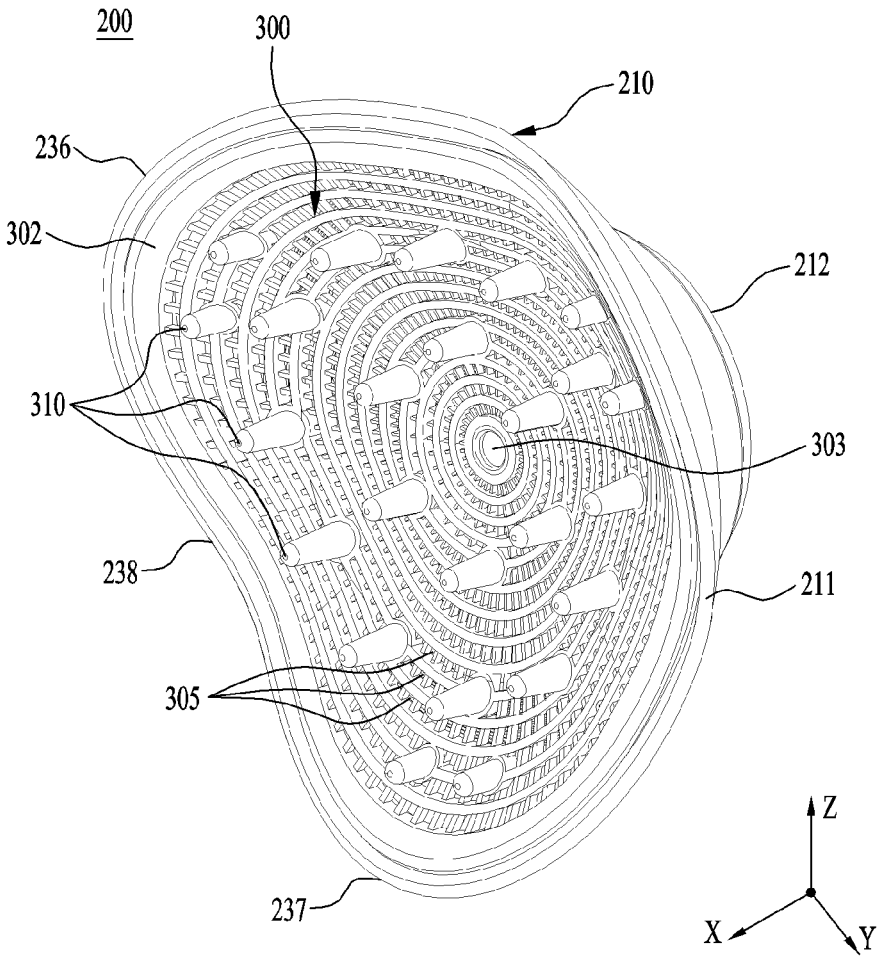
FIG. 5 is a view showing a diffuser according to an embodiment.

Referring to FIGS. 5 and 6, the diffuser 200 may be removably coupled to the main body 110 so that the gas discharged from the gas outlet 150 may be introduced into the diffuser 200 and to be discharged to the outside of the hair dryer 100. The diffuser 200 may alternatively be referred to as a head or nozzle head.

The diffuser 200 may be coupled to the main body 110 such that a rear side thereof covers the gas outlet 150, and the gas discharged from the gas outlet 150 may flow into the diffuser 200 through a gas inlet hole 215 defined at a rear side of the diffuser 200.

The user may selectively use the diffuser 200 for scalp or hair management. For example, the user may use a diffuser 200 including a massage protrusion or bristle 310 and a light irradiator or light 260, which will be described later, for scalp care. The user may also use the same diffuser 200 to dry hair, and a shape of the diffuser 200 may be configured such that a flow of a cross-sectional area of the gas is increased as needed in a hair drying step.

The rear side of the diffuser 200 may be coupled to the front end 112 of the main body 110. A first coupling portion or member 120 (FIG. 4) may be provided at the front end 112 of the main body 110, and a second coupling portion or member 220 configured to be coupled to the first coupling portion 120 may be provided at the rear side of the diffuser 200.

A coupling scheme between the diffuser 200 and the main body 110 may vary. The diffuser 200 may be coupled to the main body 110 in a scheme such as screw coupling, fitting coupling, magnetic coupling, or sliding coupling to receive the gas from the main body 110.

An embodiment of the present disclosure may improve ease of use of the user as the diffuser 200 is provided to be removable from the main body 110. For example, the user may remove the diffuser 200 when the user desires to use more concentrated gas discharged directly from the gas outlet 150 of the main body 110. Further, the user may add the diffuser 200 to the main body 110 when the user wants a more diffused or dispersed flow of gas.

The diffuser 200 may include a diffusing case 210 and a discharge or diffuser cover 300. The diffusing case 210 and a discharge cover 300 may form an exterior of the diffuser 200.

The diffuser may have a curved bell shape or hat shape. An inner diameter of the diffuser 200 may increase in a forward direction. An internal cross-sectional area of the diffusing case 210 and discharge cover 300 increases from a rear side or end 212 to a front side or rim 211.

Accordingly, gas delivered from the gas outlet 150 may be provided to the user in a state in which a flow cross-sectional area thereof is increased as the gas speed is reduced in the forward direction of the diffuser 200. The user may use the diffuser 200 for natural drying, styling, etc. for hair.

The front side 211 of the diffusing case 210 may be opened to define an open front surface. An entirety or a portion of the front surface of the diffusing case 210 may define the open surface. The gas present inside the diffuser 200 may be discharged to the outside through the open surface of the diffusing case 210 and be provided to the user while being discharged forward through the front side 211.

The open surface defined at the front side 211 of the diffusing case 210 may be exposed to the outside, or the discharge cover 300 may be provided to be coupled to the open surface.

FIG. 5 shows a state in which the discharge cover 300 is coupled to the open surface. The discharge cover 300 may include at least one gas discharge hole 305 defined therein through which the gas may be discharged. The discharge cover 300 may have a shape corresponding to the open surface of the diffusing case 210 and may be coupled to the diffusing case 210 to be located on or at the open surface.

A plurality of gas discharge holes 305 may be defined and may be spaced apart from each other in the front surface of the discharge cover 300. FIG. 5 shows a plurality of gas discharge holes 305 that are uniformly distributed and arranged in the front surface of the discharge cover 300. In such an arrangement, gas may be discharged through an entirety of the front surface of the discharge cover 300, and the user may receive gas that is discharged forward through the discharge cover 300 and more uniformly dispersed.

The discharge cover 300 may be provided such that an edge 302 located on the outermost side with respect to a radial direction of the diffuser 200 is in close contact with the diffusing case 210. The diffusing case 210 may have a front circumferential portion or rim 236 surrounding the open surface in the front side 211, and the edge 302 may have a shape corresponding to that of the front circumferential portion 236 and may be in contact with the front circumferential portion 236.

The front circumferential portion 236 may have a first portion 237 and a second portion 238. The first portion 237 and the second portion 238 may be arranged with different distances from the gas inlet hole 215 and/or rear side 212 of the diffusing case 210. The first and second portions 237 and 238 may represent various curves or waves defined by an outer edge of the diffusing case 210. The first portion 237 may be a hump or mountain and the second portion 238 may be a valley such the front circumferential portion 236 is further forward at the first portion 237 than at the second portion 238. The edge 302 of the discharge cover 300 may be molded to correspond to shapes of the first portion 237 and the second portion 238 so as to be in close contact with the front circumferential portion 236 of the diffusing case 210.

The front circumferential portion 236 of the diffusing case 210 and the edge 302 of the discharge cover 300 may be designed to fit over or on a head of the user with an arbitrary curved surface while respectively having curvatures and having different lengths protruding forward along an outer circumferential direction of the diffuser 200. Accordingly, a proximity or molding with the scalp or the hair of the user may be efficiently increased to minimize a space between the head of the user and the diffuser 200, thereby increasing a heating, drying, or treating effect. An amount of gas discharged forward through the discharge cover 300 and/or an amount or intensity of light provided by the light irradiator 260 may be efficiently increased.

An ergonomic design is made through the front circumferential portion 236 of the diffusing case 210 and the edge 302 of the discharge cover 300, which may be arranged to form curves when viewed from the side as described above and shown in the figures. In this case, the curvatures and the like of the front circumferential portion 236 and the edge 302 may be designed based on a standard head that is statistically determined.

For example, an embodiment of the present disclosure may define a R127 curvature design from a shape of the standard head, and design the shapes of the front circumferential portion 236 and the edge 302, and an overall shape of the diffusing case 210 and discharge cover 300, to correspond thereto.

In one example, a proximity or distance sensor 269 may be provided inside the diffusing case 210 to improve ease of use and efficiency of the diffuser 200. An open region or hole 303 may be defined in the discharge cover 300 such that a distance measurement accuracy of the proximity sensor 269 for a target in front of the diffuser 200 (e.g., the hair or the scalp of the user) may be improved. The proximity sensor 269 may be implemented in various schemes such as pressure, ultrasound, infrared, laser, light, etc. to measure a distance to the target in front of the proximity sensor 269, and a region of the discharge cover 300 in front of the proximity sensor 269 may be opened to define the open region 303.

In one example, FIG. 5 shows a discharge cover 300 having a plurality of massage protrusions or bristles 310. The massage protrusions 310 may have a pillar shape protruding forward from the diffuser 200 and may press the scalp of the user to provide a massage effect. A cross-sectional shape, a protruding length, an arrangement form, and the like of the massage protrusions 310 may be variously determined in terms of a design. An embodiment of the present disclosure provides the user with scalp massage through the massage protrusions 310 while also providing the gas diffused through a front surface of the discharge cover 300 to the user, thereby providing the improved ease of use and facilitating scalp and hair care.

Figure 7:
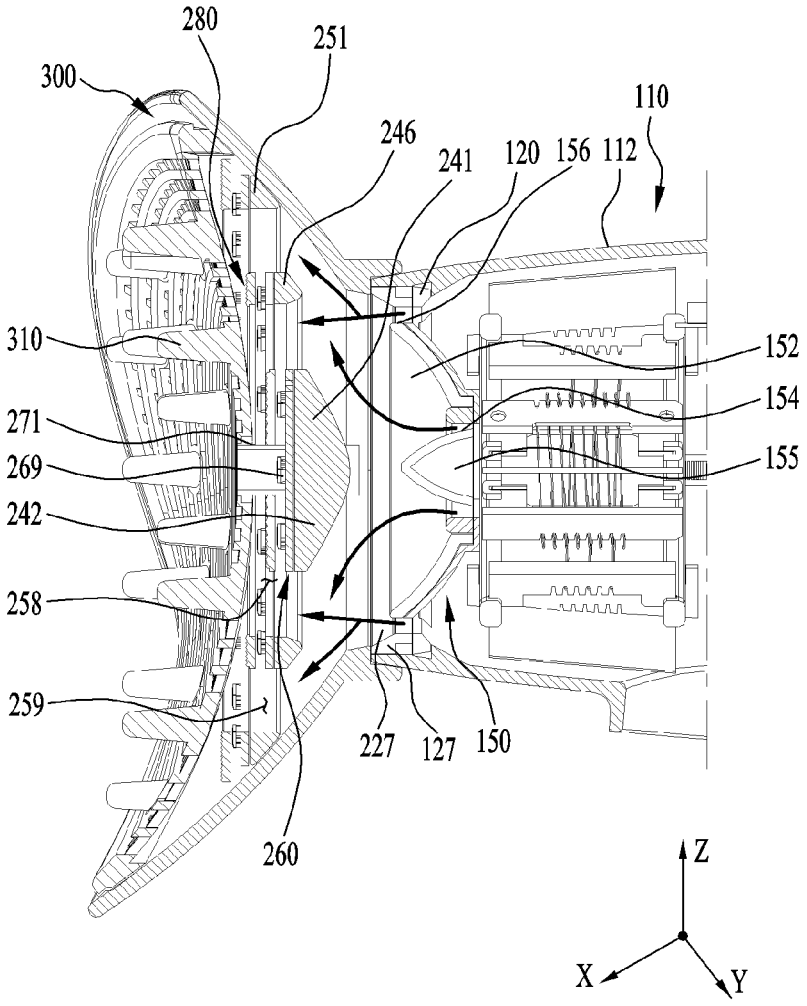
FIG. 7 is a view showing an internal cross-section of a diffuser according to an embodiment.

Referring to FIGS. 6 and 7, the diffuser 200 may include the diffusing case 210, a guide frame 240, the light irradiator 260, a light diffusion frame 280, and the discharge cover 300.

A rear side 212 of the diffusing case 210 may be coupled with the main body 110, and the open surface may be defined in the front side 211. The inner diameter of the diffusing case 210 may increase from the rear side 212 to the front side 211 so that the gas exiting the main body 110 may be diffused and discharged to the outside. The gas discharged through the gas outlet 150 of the main body 110 may be provided to the user in a state in which the flow cross-sectional area thereof is increased as the gas is flowing in the diffusing case 210.

FIGS. 6 and 7 show a diffusing case 210 in which the inner diameter thereof increases from the rear side 212 to the front side 211 and accordingly an outer diameter thereof increases in the same manner. The gas inlet hole 215 may be defined in the rear side 212 of the diffusing case 210. When the diffusing case 210 is coupled to the main body 110, the gas inlet hole 215 may be positioned to face, surround, or communicate with the gas outlet 150. Further, the gas discharged from the gas outlet 150 may be introduced into the diffusing case 210 through the gas inlet hole 215.

The gas inlet hole 215 may be located at a center of the rear side 212 of the diffusing case 210 when viewed from the rear, and a cross-sectional shape of the gas inlet hole 215 may correspond to that of the gas outlet 150. For example, the gas inlet hole 215 may be defined to have an inner diameter larger than that of the side opening 156 of the gas outlet 150, so that the gas discharged from the gas outlet 150 may be completely introduced into the diffusing case 210 through the gas inlet hole 215.

The second coupling portion 220 coupled to the main body 110 may be provided on the rear side 212 of the diffusing case 210. The diffusing case 210 may include a rear circumferential portion or body 217 surrounding the gas inlet hole 215 in the rear side 212, and the second coupling portion 220 may be provided at a rear end or side of the rear circumferential portion 217 surrounding the gas inlet hole 215.

The second coupling portion 220 may further include a coupling sleeve or flange 224. The coupling sleeve 224 may extend rearward from the rear of the rear circumferential portion 217. The coupling sleeve 224 may be provided to outwardly surround the front end 112 of the main body 110 when the diffuser 200 is coupled to the main body 110.

The first coupling portion 120 may be provided at the front end 112 of the main body 110 and may have a first magnetic fastening portion 127 (e.g., a magnet of a first polarity or a metal) embedded inside the outer wall of the front end 112 or located inside the outer wall. The first coupling portion 120 may further include a power transmitter or transceiver (e.g., a wireless power transceiver that works through electromagnetic induction) provided on an outer surface or a front surface of the outer wall of the front end 112.

The second coupling portion 220 may have a second magnetic fastening portion 227 (e.g., a magnet of a second polarity or a metal) embedded in the rear circumferential portion 217 or located inside the rear circumferential portion 217. The second coupling portion 220 may further include a power receiver or transceiver (e.g., a wireless power transceiver that works through electromagnetic induction) provided on or at an inner surface or rear surface of the coupling sleeve 224.

The first coupling portion 120 may be coupled to the second coupling portion 220. At least one of the first magnetic fastening portion 127 and the second magnetic fastening portion 227 may include a magnetic force generator (e.g., a ferromagnetic material or an electric current) so that the first magnetic fastening portion 127 and the second magnetic fastening portion 227 may be magnetically coupled to each other. The magnetic coupling means a scheme of mutual coupling through a magnetic force generated from the magnetic force generator, which may be implemented as a magnet and/or an electromagnet.

The power transmitter may supply power to the power receiver, which may be aligned, in contact with, or in connection with the power receiver when the diffuser 200 is coupled to the main body 110. The power receiver may be connected to components or devices of the diffuser 200 (e.g., the light irradiator 260, the proximity sensor 269, and the moisture measurement protrusion 312 described later) to supply power thereto.

The open surface surrounded by the front circumferential portion 236 may be defined in the front side 211 of the diffusing case 210, and the gas inside the diffusing case 210 may be discharged forward through the diffuser 200 through the open surface in the front side 211.

The guide frame 240 may be provided inside the diffusing case 210. The guide frame 240 may guide the flow of the gas introduced through the gas inlet hole 215.

The guide frame 240 may face the gas inlet hole 215 of the diffusing case 210. The guide frame 240 may have a diffusion portion or base 241 at a center thereof, a first guide or ring 246 provided radially outward of the diffusion portion 241, and a second guide or ring 251 provided radially outward of the first guide 246. The guide frame 240 may include a guide connector, rib, or tab 253 extending along the radial direction of the diffuser 200 to connect the diffusion portion 241, the first guide 246, and the second guide 251 to each other.

The diffusion portion 241 of the guide frame 240 may face the gas inlet hole 215 to diffuse the gas introduced through the gas inlet hole 215 outward in the radial direction. The flow cross-sectional area of the gas introduced through the gas inlet hole 215 may be increased by the diffusion portion 241.

A flow direction of the gas discharged from the center opening 154 may be changed by the diffusion portion 241. The diffusion portion 241 may have a larger diameter than the center opening 154, and diffuse the gas provided from the center opening 154 outward in the radial direction.

The first guide 246 may have a ring shape, and the diffusion portion 241 may be located at a center of the first guide 246. The diffusion portion 241 may have a circular cross-section, and may be outwardly spaced apart from the diffusion portion 241 while being concentric with the diffusion portion 241 of the first guide 246.

A first flow path or opening 258 may be provided between the first guide 246 and the diffusion portion 241. The first guide 246 may be spaced apart from the diffusion portion 241 to define the first flow path 258 between the first guide 246 and the diffusion portion 241. The gas diffused through the diffusion portion 241 may flow through the first flow path 258.

The second guide 251 may have a ring shape corresponding to the ring shape of the first guide 246, and the diffusion portion 241 and the first guide 246 may be located at a center of the second guide 251. The second guide 251 may be concentric with the diffusion portion 241 and the first guide 246 and may be spaced apart from the first guide 246.

An inner diameter of the first guide 246 may be larger than the diameter of the diffusion portion 241, and an inner diameter of the second guide 251 may be larger than an outer diameter of the first guide 246. Accordingly, the first flow path 258 may be defined between the diffusion portion 241 and the first guide 246, and a second flow path or opening 259 may be defined between the first guide 246 and the second guide 251.

The gas diffused by the diffusion portion 241 may flow through the first flow path 258 and the second flow path 259. An outer diameter of the second flow path 259 may be larger than the diameter of the gas inlet hole 215, so that the gas introduced through the gas inlet hole 215 may be diffused by the diffusion portion 241 and flow with a larger flow cross-section.

The light irradiator 260 may be located in front of the guide frame 240 and installed on a front surface of the guide frame 240. The light irradiator 260 may have a plurality of light emitters 262 (e.g., light emitting diodes or LEDs) arranged on a circuit board 265. The circuit board 265 may include a plurality of circuit boards separated from each other, and the plurality of boards of the circuit board 265 may have a size, shape and arrangement corresponding to that of the diffusion portion 241, the first guide 246, and the second guide 251 of the guide frame 240. The circuit board 265 may not interfere with gas or air flowing through the first and second flow paths 258 and 259.

The plurality of circuit boards 265 may respectively include a central board or base 266, a first board or ring 267, and a second board or ring 268. The central board 266 may have a cross-sectional shape corresponding to the diffusion portion 241. For example, the diffusion portion 241 may have the circular cross-section, and the central board 266 may have a circular cross-section in the same manner as the diffusion portion 241. The central board 266 may be provided on or at a front surface of the diffusion portion 241 and may include a plurality of light emitters 262.

The first board 267 may have a shape corresponding to the first guide 246. For example, the first guide 246 may have a ring shape, and the first board 267 may have a ring shape in the same manner as the first guide 246. The first board 267 be provided on or at a front surface of the first guide 246 and may include a plurality of light emitters 262.

The second board 268 may have a shape corresponding to the second guide 251. For example, the second guide 251 may have a ring shape, and the second board 268 may have a ring shape in the same manner as the second guide 251. The second board 268 may be provided on or at a front surface of the second guide 251 and may include a plurality of light emitters 262.

The central board 266, the first board 267, and the second board 268 may be arranged to be concentric like the diffusion portion 241, first guide 246, and second guide 251 of the guide frame 240. The first board 267 may be outwardly or radially spaced apart from the central board 266, and the second board 268 may be outwardly or radially spaced apart from the first board 267. An inner diameter of the first board 267 may be larger than a diameter of the central board 266, and an inner diameter of the second board 268 may be larger than an outer diameter of the first board 267. Like the guide frame 240, the first flow path 258 may be located between the central board 266 and the first board 267, and the second flow path 259 may be located between the first board 267 and the second board 268.

A position of the light irradiator 260 may be secured by a coupling between the light diffusion frame 280 and the guide frame 240, which will be described later. Alternatively, the central board 266, the first board 267, and the second board 268 may be optionally coupled (e.g., adhered, welded, or pressed-fit) to front surfaces of the diffusion portion 241, the first guide 246, and the second guide 251, respectively. The circuit board 265 may include optional tabs or connectors corresponding to the guide connectors 253 to connect the central board 266, the first board 267, and the second board 268 to each other. When such optional connectors are included, the optional connectors may be coupled to (e.g., adhered, welded, or pressed-fit) to the guide connectors 254 of the guide frame 140 and/or light diffusion connectors 288 of the light diffusion frame 280 described later. As another alternative, when such optional connectors are included, the circuit board 265 may be coupled to just one or two of the front surfaces of the diffusion portion 241, the first guide 246, and the second guide 251. For example, the central board 266 may be secured to the diffusion portion 241, while the first and second boards 267 and 268 merely contact and/or are merely positioned to align with the first guide 246, and the second guide 251, respectively.

The light irradiator 260 may irradiate light toward the front side 211 of the diffusing case 210 through the plurality of light emitters 262. The light irradiated from the light irradiator 260 may be emitted toward a location ahead or forward of the diffuser 200 through the front side 211 of the diffusing case 210.

For example, the light irradiated from the light irradiator 260 may pass through the open surface of the diffusing case 210 and through the gas discharge holes 305 of the discharge cover 300, through the massage protrusion 310 of the discharge cover 300, or, if the discharge cover 300 is made of a transparent or translucent material, through a main body or portion the discharge cover 300.

As the light is irradiated forward from the diffuser 200, the diffuser 200 may treat a user's hair or scalp care. The light irradiated from the light irradiator 260 may contribute to improving scalp and hair health while drying the user's scalp or hair or while providing heat to the user's scalp or hair. The wavelength of the light irradiated from the light emitter 262 may be predetermined or may be selected by the user. For example, red light (620-660 nm) may be used to prevent hair loss or increase blood flow to the scalp, or UV light (100-400 nm) may be used to sanitize the scalp or treat skin conditions such as scalp psoriasis.

The proximity sensor 269 may be provided on the circuit board 265 of the light irradiator 260. FIG. 6 shows a state in which the proximity sensor 269 is provided on the central board 266 of the light irradiator 260.

The proximity sensor 269 may be provided at a center of the central board 266. The proximity sensor 269 may be provided to measure a separation distance from the target positioned in front of the proximity sensor 269. The controller 115 may be provided to control the light irradiator 260 based on the separation distance between the proximity sensor 269 and the target measured by the proximity sensor 269.

For example, when the separation distance from the target measured by the proximity sensor 269 is equal to or less than a reference or predetermined distance, the controller 115 may control the light irradiator 260 such that the light irradiator 260 irradiates the light forward via the light emitters 262. The reference distance may be predetermined in terms of a design or control. The light irradiator 260 may also be operated through a physical switch, which may be operated even when the separation distance measured by the proximity sensor 269 is equal to or less than the reference distance. As the proximity sensor 269 is used, the light irradiator 260 may be operated when the separation distance from the target in front of the diffuser 200 (i.e., the scalp or the hair of the user) is equal to or less than the reference distance, thereby improving ease of use and an operation efficiency.

The proximity sensor 269 may be provided in various types. For example, the proximity sensor 269 may be a pressure sensor that detects whether a pressing force is applied from the user's scalp or hair, or a photosensitive sensor that measures a level at which an amount of sensed light decreases as the separation distance from the scalp or the hair decreases.

In addition, the proximity sensor 269 may be an infrared (IR) sensor that measures an infrared ray transmitted from the target to measure the separation distance from the scalp or the hair. In this case, the proximity sensor 269 may be provided to irradiate the infrared ray forward.

The light diffusion frame 280 may be located in front of the light irradiator 260. The light diffusion frame 280 may be installed on a front surface of the light irradiator 260 to forwardly cover the light emitters 262 of the light irradiator 260.

The light diffusion frame 280 may include a central light diffusion portion or diffuser 282, a first light diffusion portion or diffuser 284 and a second light diffusion portion or diffuser 286. The light diffusion frame 280 may further include a light diffusion connector 288 to connect the central light diffusion portion 282, the first light diffusion portion 284, and the second light diffusion portion 286 to each other.

The central light diffusion portion 282 may have a cross-sectional shape corresponding to that of the central board 266. For example, the central board 266 may have a circular cross-section, and the central light diffusion portion 282 may have a circular cross-section in the same manner as the central board 266 and may cover the front surface of the diffusion portion 241.

The first light diffusion portion 284 may have a shape corresponding to the first board 267. For example, the first board 267 may have the previously described ring shape, and the first light diffusion portion 284 may have a ring shape in the same manner as the first board 267 and may cover the front surface of the first board 267.

The second light diffusion portion 286 may have a shape corresponding to the second board 268. For example, the second board 268 may have the previously described ring shape, and the second light diffusion portion 286 may have a ring shape in the same manner as the second board 268 and may cover the front surface of the second board 268.

The central light diffusion portion 282, the first light diffusion portion 284, and the second light diffusion portion 286 may be arranged to be concentric like the arrangement of the guide frame 240 and the light irradiator 260. The first light diffusion portion 284 may be outwardly spaced apart from the central light diffusion portion 282, and the second light diffusion portion 286 may be outwardly spaced apart from the first light diffusion portion 284 so as not to block a flow of discharged air or gas.

An inner diameter of the first light diffusion portion 284 may be larger than a diameter of the central light diffusion portion 282, and an inner diameter of the second light diffusion portion 286 may be larger than an outer diameter of the first light diffusion portion 284. Like the guide frame 240, the first flow path 258 may be located between the central light diffusion portion 282 and the first light diffusion portion 284, and the second flow path 259 may be located between the first light diffusion portion 284 and the second light diffusion portion 286.

The diffuser 200 may be provided in a shape in which the first flow path 258 and the second flow path 259 are extended in the front and rear directions through the guide frame 240, the light irradiator 260, and the light diffusion frame 280. The light diffusion connector 288 may be provided in a shape corresponding to the guide connector 253. For example, the guide connector 253 and the light diffusion connector 288 may have an extended shape along the radial direction of the diffuser 200.

The light diffusion connector 288 may be located in front of and aligned with the guide connector 253 so as not to block a flow of discharged air or gas. The light diffusion frame 280 may be fixed inside the diffusing case 210 as the light diffusion frame 280 is fastened to the guide connector 253.

An embodiment of the present disclosure is advantageous in terms of a design and structurally stable in that, in a state in which the guide frame 240 is constituted by a plurality of components, the plurality of components may be able to be handled as a single component through the guide connector 253. In addition, an embodiment of the present disclosure is advantageous in terms of the design and structurally stability in that, in a state in which the light diffusion frame 280 is constituted by a plurality of components, the plurality of components are able to be handled as a single component through the light diffusion connector 288.

Furthermore, the light diffusion connector 288 of the light diffusion frame 280 may be coupled to the guide connector 253 of the guide frame 240, so that all of the central light diffusion portion 282, the first light diffusion portion 284, and the second light diffusion portion 286 may be stably fixed and secure, which is advantageous in terms of coupling.

The light diffusion frame 280 may be made of a material through which light is transmitted (i.e., a transparent or translucent material, such as plastic or glass). The light irradiated from the light irradiator 260 may be scattered and diffused while passing through the light diffusion frame 280. The light diffusion frame 280 may be provided in front of the light irradiator 260 so that the light irradiated from the light irradiator 260 may be provided to the user while being scattered and diffused and being uniformly dispersed in a larger area.

A treatment for the diffusion or the scattering of the light may be performed on a front surface or a rear surface of the light diffusion frame 280. For example, etching may be performed or a pattern through laser processing and the like may be formed on a surface of the light diffusion frame 280.

In one example, the central light diffusion portion 282 may shield the front surface of the central board 266, and a portion of the central light diffusion portion 282 in front of the proximity sensor 269 may be opened or formed with a hole such that the measurement of the separation distance from the target in front of the diffuser 200 via the proximity sensor 269 may be convenient or undisturbed. When the proximity sensor 269 is provided at the center of the central board 266, the central light diffusion portion 282 may have a hole defined at a center thereof (as shown in the figures) to expose the proximity sensor 269 forwardly and allow transmission of a signal to or from the proximity sensor 269.

The discharge cover 300 may shield the open surface defined in the front side 211 of the diffusing case 210 in which the guide frame 240, the light irradiator 260, and the light diffusion frame 280 may be embedded. The plurality of gas discharge holes 305 may be defined in the discharge cover 300 so that gas may be discharged and the light may be irradiated forward.

The edge 302 of the discharge cover 300 may have a curvature configured to correspond to that of the front circumferential portion 236 of the diffusing case 210 when viewed from the side. A front surface of the discharge cover 300 may form a curved surface that is indented or recessed rearwards centerwardly so that the discharge cover 300 may have a shape corresponding to the head of the user, which may facilitate a massage effect through the massage protrusions 310 while providing the gas or air and the light to the user.

The plurality of massage protrusions 310 may each have a contact portion provided on a front surface or end thereof. The contact portions of the plurality of massage protrusions 310 may be configured such that a sense of touch with the scalp or the hair of the user may be improved and damage to the scalp and the hair may be minimized. For example, the contact portion may be made of an elastic or soft material such as silicon, rubber, or plastic.

The discharge cover 300 may also include at least one moisture measurement protrusion or sensor 312, which may also serve as a massage protrusion 310. The moisture measurement protrusion 312 may be provided to measure a moisture amount of the scalp or the hair of the user. A pair of moisture measurement protrusions 312 may be arranged to measure an impedance, such as a bioelectrical impedance through an electric field formed therebetween.

The moisture measurement protrusions 312 may be connected to the controller 115. The controller 115 may determine the impedance using a voltage, a current, a resistance, and the like, which are identified through the moisture measurement protrusion 312, and determine the moisture amount of the scalp or the hair of the user based on the determined impedance. The controller 115 may further control an operation of the fan 119, the temperature adjuster 117, or the light irradiator 260 based on the determined moisture amount.

For example, the controller 115 may control the fan 119 to increase a rotation speed (such that the speed of discharged gas increases) as the determined moisture amount of the scalp or the hair of the user increases. Alternatively or in addition thereto, the controller 115 may control the temperature adjuster 117 such that a temperature of the discharged gas increases and/or control the light irradiator 260 such that a light amount or intensity increases as the determined moisture amount of the scalp or the hair of the user increases. A light amount or intensity may be increased by increasing a number of light emitters 262 emitting light and/or increasing an intensity of light emitted by each light emitter 262.

A pair of moisture measurement protrusions 312 may include a first moisture measurement protrusion 315 electrically having a first pole and a second moisture measurement protrusion 316 having a second pole opposite to the first pole. The controller 115 may determine the impedance and the moisture amount through the electric field formed between the first moisture measurement protrusion 315 and the second moisture measurement protrusion 316.

A plurality of pairs of moisture measurement protrusions 312, each of which includes the first moisture measurement protrusion 315 and the second moisture measurement protrusion 316, may be arranged. One pair of moisture measurement protrusions 312 may be provided to be spaced apart from another pair of moisture measurement protrusions 312, and different massage protrusions 310 may be positioned therebetween.

In one example, the open region 303 may be defined at a center of the discharge cover 300. The proximity sensor 269 may be exposed forward through the hole defined in the light diffusion frame 280 and the open region 303 of the discharge cover 300, and may measure the separation distance from the target in front of the diffuser 200. A protection member (e.g., a transparent film or layer) that protects the proximity sensor 269 and allows the infrared ray or the like to pass straight therethrough may be provided in front of the proximity sensor 269 (e.g., in a center hole of the light diffusion frame or in the open region 303).

Referring to FIG. 7, the first coupling portion 120 of the main body 110 may include the first magnetic fastening portion 127, and the second coupling portion 220 of the diffuser 200 may include the second magnetic fastening portion 227. The diffuser 200 may be coupled to the front end 112 of the main body 110 through a magnetic coupling or interaction between the first magnetic fastening portion 127 and the second magnetic fastening portion 227. The first coupling portion 120 may further include a hook fastener or loop, and the second coupling portion 220 may further include a hook configured to be fastened to the hook fastener so that a coupling stability between the diffuser 200 and the main body 110 may be enhanced.

Hereinafter, a flow of the gas discharged from the gas outlet 150 according to an embodiment of the present disclosure will be described with reference to FIG. 7. In the gas outlet 150, the gas is discharged from the center opening 154 and the side opening 156. The gas inlet hole 215 of the diffusing case 210 may have a diameter equal to or larger than that of the side opening 156 and face the gas outlet 150 so that the gas discharged from the center opening 154 and the side opening 156 may be introduced into the inlet hole 215.

The guide frame 240 may be provided inside the diffusing case 210 to face the gas outlet 150. The diffusion portion 241 of the guide frame 240 may be positioned to face the center opening 154 of the gas outlet 150.

The gas discharged from the center opening 154 may flow toward the diffusion portion 241. As the diffusion portion 241 has a diameter larger than that of the center opening 154, the gas discharged from the center opening 154 may be diffused outward along the radial direction of the diffuser 200.

The diffusion portion 241 may have a diffusion protrusion or dome 242 on a rear surface thereof facing the center opening 154. The diffusion protrusion 242 may have a curvature such that a diameter thereof decreases in a rearward direction to protrude or point toward the gas outlet 160. The diameter of the diffusion protrusion 242 may decrease toward a center, which may face the gas outlet 160. A diffusion effect of the gas discharged from the center opening 154 may be improved by the diffusion protrusion 242.

At least a portion of the gas discharged from the center opening 154 may flow along the first flow path 258 defined between the diffusion portion 241 and the first guide 246 in the guide frame 240 by the diffusion portion 241 and the diffusion protrusion 242. In one example, the gas discharged from the side opening 156 may flow outward to surround the gas discharged from the center opening 154, and the gas discharged from the side opening 156 may also diffuse outward along the radial direction of the diffuser 200 as the gas of the center opening 154 is diffused by the diffusion portion 241. At least a portion of the gas discharged from the side opening 156 and at least a portion of the gas discharged from the center opening 154 may flow along the second flow path 259 defined between the first guide 246 and the second guide 251 in the guide frame 240.

Despite a design feature where the inner diameter of the diffuser 200 may increase in a forward direction, the discharging of the gas through the center opening 154 and the side opening 156 in the forward direction while being maintained in a specific form may be effectively suppressed through the guide frame 240. The diffuser 200 may allow the gas discharged from the center opening 154 and the side opening 156 to be effectively dispersed and diffused with a larger flow cross-sectional area while preventing the flow of the gas from being maintained in the specific form.

In one example, the light irradiator 260 and the light diffusion frame 280 may be arranged in front of the guide frame 240 inside the diffusing case 210. The light irradiator 260 and the light diffusion frame 280 may be coupled with the guide frame 240 and may be handled as a single component, improving space utilization, convenience, security, and design.

The light irradiator 260 and the light diffusion frame 280 may define the first flow path 258 and the second flow path 259 together with the guide frame 240. The flow of the gas formed by the guide frame 240 may be effectively maintained, and the gas may be discharged forward from the diffuser 200 through the light irradiator 260 and the light diffusion frame 280.

In the light irradiator 260, the first board 267 may be positioned to be forward or in front of of the central board 266, and the second board 268 may be positioned to be forward or in front of the first board 267. The plurality of light emitters 262 arranged in the light irradiator 260 may be arranged to form a spherical or curved surface that is indented or recessed rearward. The plurality of light emitters 262 may be arranged in a form in which a distance from a center of the light irradiator 260 along the radial direction increases forwardly. Such arrangement of the light emitters 262 may correspond to the shape of the front surface of the discharge cover 300 indented rearward. The plurality of light emitters 262 arranged on the light irradiator 260 may be arranged to form the curved surface to correspond to the user's head having a curvature, so that a uniform amount of light may be provided to the user's scalp and hair.

Like the light irradiator 260, the guide frame 240 may be provided such that the first guide 246 may be positioned] forward or in front of the diffusion portion 241, and the second guide 251 may be positioned forward or in front of the first guide 246. The first board 267 provided on the front surface of the first guide 246 may be positioned forward or in front of the central board 266 provided at the front surface of the diffusion portion 241, and the second board 268 provided at the front surface of the second guide 251 may be positioned forward or in front of the first board 267.

Like the light irradiator 260, in the light diffusion frame 280, the first light diffusion portion 284 may be positioned forward or in front of the central light diffusion portion 282, and the second light diffusion portion 286 may be positioned forward or in front of the first light diffusion portion 284. A distance between the light diffusion frame 280 and the light irradiator 260 may be kept constant, and uniform dispersion and scattering of the light may be induced. In the guide frame 240, as the second guide 251 may be positioned forward of the first guide 246 and the first guide 246 may be positioned forward of the diffusion portion 241, a space in which the gas introduced from the gas inlet hole 215 is diffused in the radial direction may be secured, and the gas may be smoothly introduced into the first flow path 258 and the second flow path 259.

FIG. 7 shows the guide frame 240, the light irradiator 260, and the light diffusion frame 280 protruding forward in a direction away from centers thereof.

FIG. 7 also shows a light blocking portion or shield 271 surrounding the proximity sensor 269. The light blocking portion 271 may have a hollow cylindrical shape, but embodiments disclosed herein are not limited. The light blocking portion 271 may be provided to surround the proximity sensor 269 along a circumferential direction of the diffuser 200, preventing a situation in which the light emitter 262 around the proximity sensor 269 affects a measurement the proximity sensor 269. The proximity sensor 269 may be located inside the light blocking portion 271. The light blocking portion 271 may have a shape extending from the central board 266 to the discharge cover 300.

The light blocking portion 271 may be opened in a forward direction to prevent structural interference from occurring in a measurement of the separation distance between the diffuser 200 and the front target by the proximity sensor 269. For example, when the proximity sensor 269 measures an infrared ray transmitted from the target, the light blocking portion 271 may have a front opening to allow the infrared ray transmitted from the target to be completely provided to the proximity sensor 269.

The light blocking portion 271 may be provided to extend rearward from the discharge cover 300, or may be formed integrally with the discharge cover 300 or integrally with the central board 266. The light blocking portion 271 may be manufactured separately from the discharge cover 300 and the central board 266, and may be later coupled to or combined with the discharge cover 300 and/or the central board 266.

As described above, the hair dryer 100 may include the main body 110, the handle 180, and the diffuser 200. The main body 110 may include the gas outlet 150 to discharge the gas introduced from the outside, and the handle 180 may extend from the main body 110.

The diffuser 200 may be removably coupled to the main body 110 so that the gas discharged from the gas outlet 150 may flow into the diffuser 200, and the gas introduced into the diffuser 200 may be discharged to the outside. The diffuser 200 may include the diffusing case 210 and the guide frame 240. The rear side 212 of the diffusing case 210 may be coupled to the main body 110, the gas discharged from the gas outlet 150 may be introduced into the diffusing case 210 through the gas inlet hole 215 defined in the rear side 212, the gas introduced into the diffusing case 210 may be discharged from the front side 211, and the inner diameter of the diffusing case 210 may increase toward the front side 211 from the rear side 212.

The guide frame 240 may be provided inside the diffusing case 210 and may guide the flow of the gas introduced through the gas inlet hole 215. The guide frame 240 may include the diffusion portion 241, and the diffusion portion 241 may be provided to face the gas inlet hole 215 to diffuse the gas introduced through the gas inlet hole 215.

Figure 8:
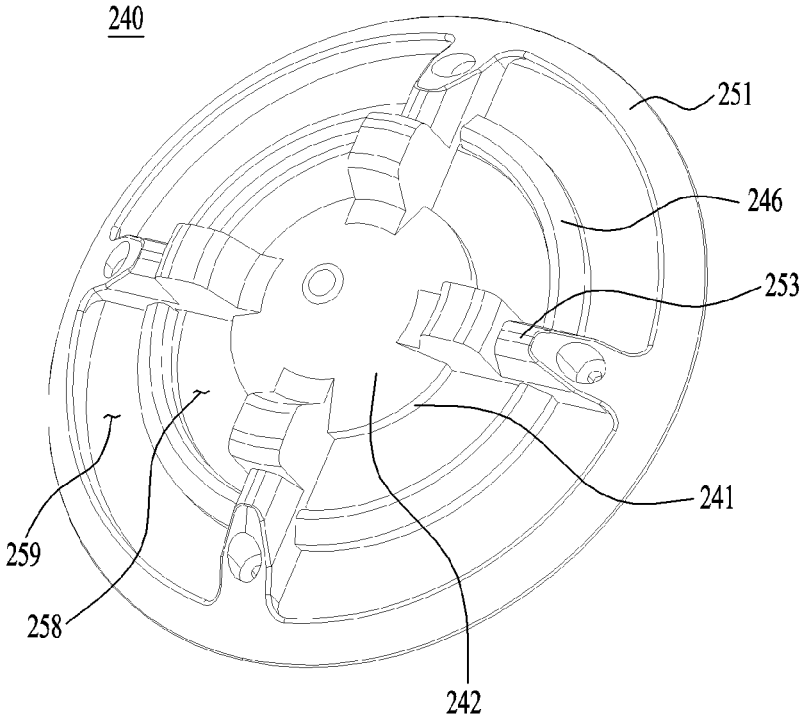
FIG. 8 is a view showing a guide frame of a diffuser according to an embodiment.

Referring to FIGS. 7 and 8, the guide frame 240 may include the diffusion portion 241 to diffuse the gas introduced from the gas inlet hole 215. The diffuser 200 may be provided such that the inner diameter of the diffusing case 210 increases in a forward direction. The gas flowing from the rear side 212 of the diffusing case 210 to the front side 211 may be discharged forward of the diffusing the case 210 in a state in which a flow cross-sectional area of the gas is increased to correspond to the inner diameter change of the diffusing case 210.

The increase of the flow cross-sectional area of the gas includes an increase of a diameter of the flow cross-sectional area in addition to an increase of the area itself. For example, referring to FIG. 7, the flow of gas introduced through the gas inlet hole 215 may have a flow cross-sectional area corresponding to a maximum diameter of the gas inlet hole 215. The gas discharged from the front side 211 of the diffusing case 210 may have a flow cross-sectional area having a diameter corresponding to the maximum front surface, that is, the open surface of the diffusing case 210 by the shape of the diffusing case 210 whose inner diameter increases forward and by the diffusion portion 241 of the guide frame 240.

In addition, the diffusion portion 241 may face the gas inlet hole 215. The gas introduced through the gas inlet hole 215 may be diffused such that the diameter of the flow cross-sectional area is increased by the diffusion portion 241. The gas may be effectively diffused inside the diffusing case 210 through the guide frame 240 and may be provided to the user with a larger area, thereby improving the ease of use and efficiency.

The diffusion protrusion 242 protruding toward the gas inlet hole 215 may be provided on a rear surface of the diffusion portion 241, and a protruding height or amount of the diffusion protrusion 242 may increase toward a center of the diffusion protrusion 242.

The diffusion protrusion 242 may rearwardly protrude from the rear surface of the diffusion portion 241, and the protruding height or amount of the diffusion protrusion 242 may increase toward the center of the diffusion protrusion 242. The diffusion protrusion 242 may have an approximately conical or curved conical shape.

However, although a cross-section of the diffusion protrusion 242 is shown to have a circular shape, the present disclosure is not limited thereto. For example, the diffusion protrusion 242 may have a circular, elliptical, or polygonal cross-section as required.

An increase rate of the protruding amount or height of the diffusion protrusion 242 that is increased inward from a circumference side to a central side of the diffusion protrusion 242 may be variously determined. For example, a protruding amount of the diffusion protrusion 242 may increase uniformly toward the central side from the circumference side thereof, may form a smooth curved surface as the increase rate gradually decreases, or may form a steep curved surface as the increase rate gradually increases. A specific shape of such diffusion protrusion 242 may be variously determined in terms of design.

The diffusion protrusion 242 may be manufactured separately from the diffusion portion 241 and later coupled to a rear surface of the diffusion portion 241. Alternatively, diffusion protrusion 242 may be integrally formed with the diffusion portion 241, so that the diffusion protrusion 242 may correspond to the rear surface of the diffusion portion 241. FIG. 8 shows a shape in which the diffusion protrusion 242 may be integrally molded on the rear surface of the diffusion portion 241 according to an embodiment.

A diffusion degree and the flow of the discharged gas may be improved by the diffusion protrusion 242. A level of diffusion in the radial direction of the diffusing case 210 of the gas introduced through the gas inlet hole 215 may be increased by the diffusion protrusion 242.

When the gas introduced through the gas inlet hole 215 directly collides with the rear surface of the diffusion portion 241 in a flat shape, the gas is diffused in the radial direction and collides with the rear surface of the diffusion portion 241, which may result in turbulence or vortex. The turbulence or vortex may act as an element that inhibits the flow of the gas inside the diffusing case 210, and a noise of the diffuser 200 may be increased or a gas with low uniformity may be provided to the user, which may be disadvantageous. Accordingly, the diffusion protrusion 242 may be provided on the rear surface of the diffusion portion 241 so that the gas introduced through the gas inlet hole 215 may be suppressed from flowing straight or flat and colliding with the diffusion portion 241, and the diffusion of the gas in the radial direction may be naturally induced.

In one example, the guide frame 240 may have a circular or ring shape, and a plurality of gas flow paths in which the diffusion portion 241 is located at a center may be defined. The plurality of gas flow paths may be defined as rings to have different diameters and the gas flows in the plurality of gas flow paths may be separated from each other.

FIG. 8 illustrates a state in which the first flow path 258 and the second flow path 259 are defined in the guide frame 240 according to an embodiment. The first flow path 258 and the second flow path 259 may respectively have ring shapes, may be open in the front and rear direction, and may have different diameters.

Although the first flow path 258 and the second flow path 259 may have different diameters, the first and second flow paths 258 and 259 may be able to form a mutual inclusion relationship as the diffusion portion 241 is provided at a center of the guide frame 240. For example, as shown in FIG. 8, the first flow path 258 may be defined inward of the second flow path 259. The first flow path 258 and the second flow path 259 may be concentric with each other, but have different diameters so that one may be defined to surround the other in a radially outward direction.

In an embodiment of the present disclosure, the number of flow paths defined by the guide frame 240 may be variously designed as needed. FIG. 8 shows the guide frame 240 having the first flow path 258 and the second flow path 259 defined therein according to an embodiment, but the present disclosure is not limited thereto. A third flow path, a fourth flow path, etc. may be additionally defined.

The first flow path 258 and the second flow path 259 may respectively correspond to paths through which the gas flows, and the air or gas that flows in the first and second flow paths 258 and 259 may be separated from each other or have separate speeds. As the diffusion portion 241 is centrally located and the plurality of gas flow paths 258, 259 that are substantially concentric and have the diameters different from each other are defined, the separate gas flows may be formed respectively in the plurality of gas flow paths 258, 259, and diffusion of the gas may be effectively achieved.

For example, when the plurality of gas flow paths 258, 259 are not defined in the guide frame 240, the gas diffused through the diffusion portion 241 may flow along a single gas flow path that may be defined radially outward of the guide frame 240 or inside the guide frame 240. As described above, the gas flowing along the single gas flow path may be limited in an increase in a flow cross-sectional area thereof. Even though the gas flowing through one gas flow path is discharged through the open surface of the diffusing case 210, the gas may have a gas flow of a distribution corresponding to a shape of one gas flow path. The gas may be provided to the user in a limited flow cross-sectional area regardless of an area of the open surface of the diffusing case 210, which may be disadvantageous in terms of ease of use.

However, as the plurality of gas flow paths 258, 259 that are substantially concentric and have the different diameters are defined by the guide frame 240, the gas introduced through the gas inlet hole 215 may be diffused by the diffusion portion 241 and introduced and moved into the plurality of gas flow paths 258, 259. The flow cross-sectional area of the gas inside the diffusing case 210 may be effectively increased, and a discharge cross-sectional area of the gas, a diffusion degree, and a uniformity of the gas on the basis of the open surface of the diffusing case 210 may be effectively improved, thereby effectively improving the ease of use.

At least one of the plurality of gas flow paths may have a diameter larger than the diameter of the gas inlet hole 215. FIG. 7 shows that the second flow path 259 of the guide frame 240 has a larger diameter than the gas inlet hole 215 according to an embodiment. For example, the second flow path 259 having a diameter larger than that of the first flow path 258 and provided outward of the first flow path 258 may have an inner diameter or an outer diameter larger than the diameter of the gas inlet hole 215.

Even when the gas introduced through the gas inlet hole 215 is diffused in the radial direction by the diffusion portion 241, when the gas flow path through which the gas flows has a diameter equal to or less than the gas inlet hole 215, the flow cross-sectional area of the gas discharged from the diffuser 200 through the gas flow path eventually does not differ significantly from the flow cross-sectional area of the gas introduced into the gas inlet hole 215. As the inner diameter of the diffusing case 210 increases forwardly, the gas introduced from the gas inlet hole 215 may diffuse in the radial direction by the diffusion portion 241, and at least some of the gas flow paths 258, 259 defined by the guide frame 240 may have diameters larger than that of the gas inlet hole 215. Thus, as the gas introduced into the diffuser 200 flows inside the diffuser 200, the flow cross-sectional area of the gas may be effectively expanded, and the gas may be provided to the user with a larger area, thereby improving the ease of use.

The first guide 246 may be formed in the ring shape, the diffusion portion 241 may be located at a center of the first guide 246, and the first flow path 258 may be defined between the first guide 246 and the diffusion portion 241. The second guide 251 may be formed in the ring shape, the diffusion portion 241 and the first guide 246 may be located at a center of the second guide 251, and the second flow path 259 may be defined between the second guide 251 and the first guide 246.

The gas introduced through the gas inlet hole 215 may flow to the front side 211 of the diffusing case 210 through the first flow path 258 and the second flow path 259. The first guide 246 and the second guide 251 may be formed in the ring shapes and may have the diffusion portion 241 located centers thereof. The diffusion portion 241, the first guide 246, and the second guide 251 may be concentric and may be spaced apart from each other.

Figure 9:
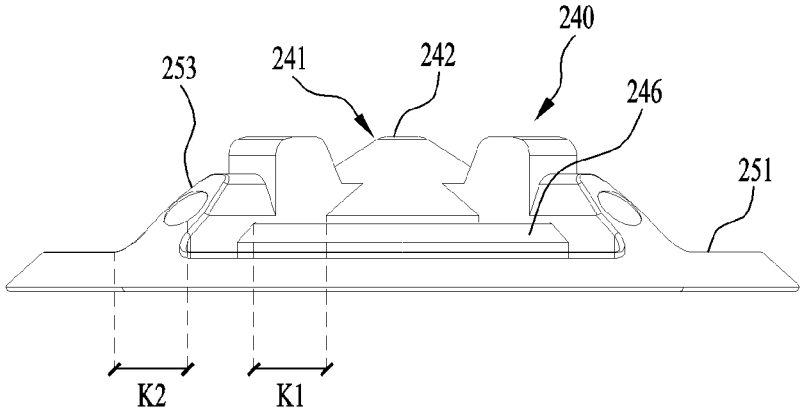
FIG. 9 is a view showing the guide frame of FIG. 8 when viewed from a side.

Referring to FIG. 9, FIG. 9 shows the first guide 246 having a separation distance K1 from the diffusion portion 241 and the second guide 251 having a separation distance K2 from the first guide 246 according to an embodiment. A width of the first flow path 258 may correspond to the separation distance K1 between the diffusion portion 241 and the first guide 246, and a width of the second flow path 259 may correspond to the separation distance K2 between the first guide 246 and the second guide 251. The first flow path 258 may be defined between the diffusion portion 241 and the first guide 246 to surround the diffusion portion 241, and the second flow path 259 may be defined between the first guide 246 and the second guide 251 to outwardly surround the first flow path 258. The first flow path 258 and the second flow path 259 may be effectively defined through the shapes and the arrangement relationship of the first guide 246 and the second guide 251.

As the first flow path 258 and the second flow path 259 may be formed in ring shapes and the diameters thereof may be gradually increased in a stepwise manner, a gas that is uniformly dispersed along the circumferential direction and also uniformly dispersed in the radial direction of the diffusing case 210 from the open surface of the diffusing case 210 may be provided to the user with a large area.

The second flow path 259 may have an outer diameter larger than the diameter of the gas inlet hole 215 so that the gas introduced through the gas inlet hole 215 may be diffused and flowed. At least one of the plurality of gas flow paths 258, 259 may have a diameter larger than that of the gas inlet hole 215, thereby contributing to the gas flow diffusion.

As described above, an embodiment of the present disclosure may have the first flow path 258 and the second flow path 259. The second flow path 259 may be defined to surround the first flow path 258 while having a diameter larger than that of the first flow path 258, and may have an outer diameter larger than the diameter of the gas inlet hole 215. The inner diameter of the second guide 251 may be larger than the diameter of the gas inlet hole 215. The gas introduced through the second flow path 259 may have a flow cross-sectional area having a diameter at least larger than that of the gas inlet hole 215, and the gas having a wide cross-sectional area may be effectively provided to the user.

Figure 10:
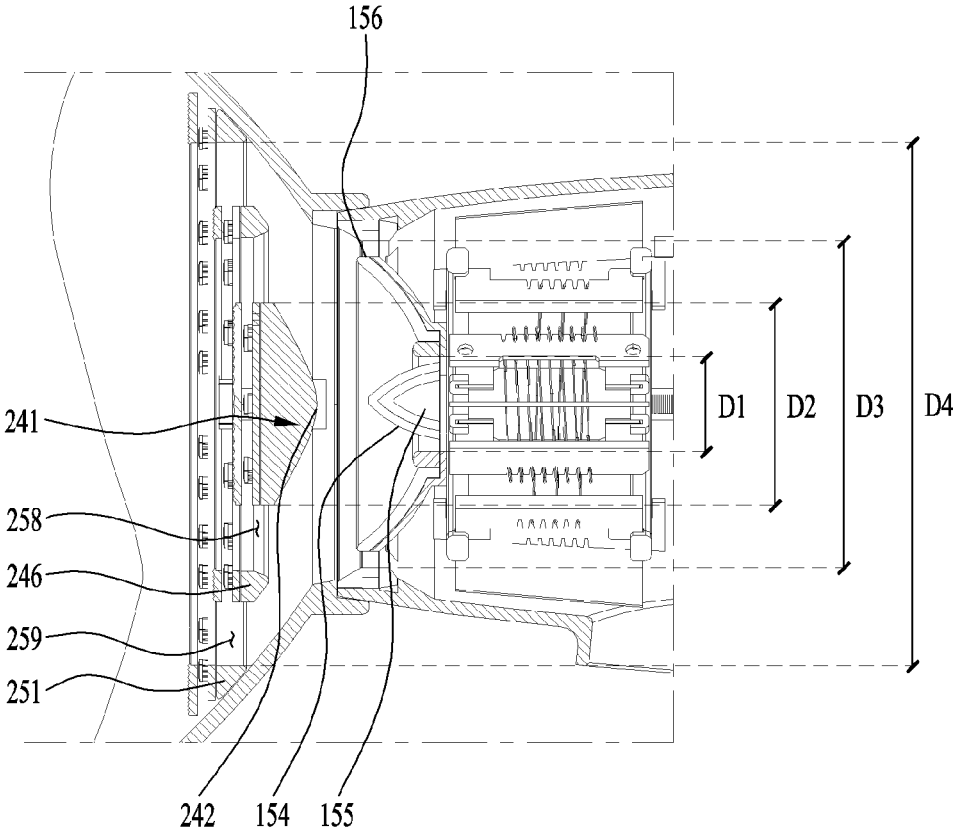
FIG. 10 is a view showing an interior of a diffuser coupled to a main body of a hair dryer according to an embodiment.

Referring to FIGS. 9 and 10, the first guide 246 may be forwardly spaced apart from the diffusion portion 241, and the second guide 251 may be forwardly spaced apart from the first guide 246. The guide frame 240 may be in a form protruding forward in a stepwise manner in an outer radial direction from the center thereof. Accordingly, a space through which the gas introduced through the gas inlet hole 215 may be diffused by the diffusion portion 241 and introduced into the first flow path 258 and the second flow path 259 may be secured.

When the diffusion portion 241, the first guide 246, and the second guide 251 are flush with each other, that is, when the diffusion portion 241, the first guide 246, and the second guide 251 are arranged at a same position in the front and rear direction, a separation distance between the second flow path 259 and the inner surface of the diffusing case 210 may be smaller than a separation distance between the first flow path 258 and the inner surface of the diffusing case 210.

A space defined between the second flow path 259 and the inner surface of the diffusing case 210 and defined rearward of the second flow path 259 may have a relatively small area and may interrupt the gas diffused by the diffusion portion 241 from being sufficiently introduced into the second flow path 259. The gas introduced through the gas inlet hole 215 may be concentrated into the first flow path 258. The gas discharged from the front side 211 of the diffusing case 210 may be more concentrated in a region corresponding to the first flow path 258 and provided to the user. This may have an adverse result for the gas diffusion effect of the diffuser 200. Accordingly, in an embodiment of the present disclosure, an inlet of the second flow path 259 may be located farther from the center of the gas inlet hole 215 than the first flow path 258 and may be defined to be forwardly spaced apart from the first flow path 258 so that the gas introduced from the gas inlet hole 215 may be sufficiently introduced into the second flow path 259, thereby effectively improving the diffusion effect of the gas.

The light irradiator 260 may have a similar structure as the guide frame 240 in that the light irradiator 260 may have portions sequentially and forwardly spaced apart from each other in the direction away from the center of the light irradiator 260 like the shape of the guide frame 240. Accordingly, the portions of the light irradiator 260 may have an arrangement structure corresponding to a sphere surface as the portions are located forward in an outward direction away from the center of the light irradiator 260, and an overall shape of the light irradiator 260 may be similar to that of the user's head. The light irradiator 260 may have a shape corresponding to a sphere surface, thereby enabling uniform light irradiation to the scalp and the hair of the user.

The guide connector 253 may be made of a material the same as or different from a material of the diffusion portion 241, the first guide 246, and the second guide 251. The guide connector 253 may be separately manufactured and have a coupling relationship with the diffusion portion 241, the first guide 246, and the second guide 251, or may be integrally molded with the diffusion portion 241, the first guide 246, and/or the second guide 251.

The shape and the arrangement structure of the guide frame 240 may be determined by the plurality of components (i.e., the diffusion portion 241, the first guide 246, and/or the second guide 251) constituting the guide frame 240. A time required during a manufacturing process or an assembly process may be increased as a number of components of the guide frame 420 increases, which may be disadvantageous. Accordingly, the present disclosure may improve the handling of the guide frame 240 in the manufacturing process of the guide frame 240 or the assembly process of the diffuser 200 by allowing the guide frame 240 to have the plurality of components separated from each other, such as the diffusion portion 241, the first guide 246, and the second guide 251, and also by allowing the plurality of components to be considered and handled as a single component through the guide connector 253.

The discharge cover 300 may be provided at the front side 211 of the diffusing case 210 and may include the gas discharge hole 305 through which the gas introduced into the diffusing case 210 is discharged to the outside. In addition, the discharge cover 300 may include the massage protrusion 310 that protrudes forward to press the target located in front of the discharge cover 300. The diffuser 200 according to an embodiment may provide the massage effect by being pressed against the user's scalp through the plurality of massage protrusions 310 arranged on the discharge cover 300.

The plurality of gas discharge holes 305 may be defined in the discharge cover 300 and may be arranged to be distributed throughout the front surface of the discharge cover 300. Accordingly, the gas flowing through the first flow path 258 and the second flow path 259 may be dispersed throughout the discharge cover 300 and discharged. When the discharge cover 300 is included in the diffuser 200, the discharge cover 300 may have an opened front surface like that of the diffusing case 210.

An entirety of the gas outlet 150 may have a hole shape, or the gas outlet 150 may include the center opening 154 and the side opening 156 as shown in FIG. 10. The center opening 154 may be defined at approximately the center of the gas outlet 150, and the gas may be discharged through the center opening 154. Further, the side opening 156 may have the ring shape and may surround the center opening 154, and the gas may be discharged through the side opening 156 along with the center hole.

The center opening 154 and the side opening 156 may be defined in the form of holes that open in the front and rear direction. The center opening 154 may correspond to a hole defined at the center of the discharge base 152 of the gas outlet 150, and the guide cone 155 may improve the gas flow and may be provided at the center of the center opening 154. A hole having a ring-shaped cross-section may be provided in the center opening 154 and surrounding the guide cone 155.

The side opening 156 may be defined to be outwardly spaced apart from the center opening 154 in the radial direction of the gas outlet 150, and may have a cross-section in a shape of a ring surrounding the center opening 154. The side opening 156 may be understood as a hole defined between the discharge base 152 and the outer wall or front end 112 of the main body 110.

The diffusion portion 241 may be provided to face the center opening 154 and may have a diameter larger than that of the center opening 154. When the center opening 154 and the side opening 156 are defined in the gas outlet 150, the diffusion portion 241 may be positioned to face the center opening 154. The diffusion portion 241 may have a diameter larger than that of the center opening 154 to diffuse gas discharged from the center opening 154 in the radial direction.

When the gas discharged from the center opening 154 is diffused in the radial direction by the diffusion protrusion 242, the gas from the center opening 154 diffuses the gas discharged from the side opening 156 outward in the radial direction. FIG. 7 shows the flow of the gas diffused as described above.

The diffusion portion 241 diffuses at least the gas of the center opening 154 outward in the radial direction in consideration of the relationship between the center opening 154 and the side opening 156, so that not only the gas of the center opening 154 but also the gas of the side opening 156 may be effectively diffused outward in the radial direction.

In one example, in the diffusing case 210, the diameter of the gas inlet hole 215 may be equal to or greater than the diameter of the side opening 156 so that the gas discharged from the center opening 154 and the side opening 156 may be introduced into the diffusing case 210. Further, the diffusion portion 241 may have a diameter larger than the diameter of the center opening 154 to diffuse the gas introduced from the center opening 154.

The hair dryer 100 may be provided such that the gas inlet hole 215 faces the gas outlet 150, and the diameter of the gas inlet hole 215 may be equal to or larger than that of the gas outlet 150. Not only the gas of the center opening 154 may be discharged from the gas outlet 150, but also the gas of the side opening 156 may also be introduced into the gas inlet hole 215 with minimal leakage or dispersion to the outside.

Further, as the above-described coupling sleeve 224 is provided to extend rearward from the circumference of the gas inlet hole 215 to surround the front end 112 of the main body 110, an entirety of the gas discharged from the gas outlet 150 may be introduced into the gas inlet hole 215. As the diffusion portion 241 may have a diameter larger than that of the center opening 154, not only the gas of the center opening 154 but also the gas of the side opening 156 may be effectively diffused by being continuously affected by the gas diffusion of the center opening 154. FIG. 10 shows the diffusion portion 241 having a diameter D2 larger than a diameter D1 of the center opening 154 according to an embodiment of the present disclosure.

In one example, the diffusion portion 241 may have a diameter smaller than an inner diameter of the side opening 156, and the side opening 156 may face the first flow path 258 in the forward direction. FIG. 10 shows a state in which, as the diameter D2 of the diffusion portion 241 is smaller than a diameter D3 of the side opening 156, the side opening 156 faces at least a portion of the first flow path 258 in the front and rear direction.

When the diameter D2 of the diffusion portion 241 is larger than an outer diameter D3 of the side opening 156, the gas discharged from the side opening 156 may not be able to flow straight and may be diffused and flow in the radial direction by the diffusion portion 241. A region where the straight flow is restricted by the diffusion portion 241 may become too large so that an amount of gas on a central side or area with respect to a cross-section of the gas discharged forward of the diffuser 200 may be reduced. In this case, the gas amount may be insufficient on the central side of the gas discharged from the diffuser 200, which may lower efficiency of the hair dryer 100. Further, a portion of the flow of the gas discharged from the diffuser 200 may be induced to the central side to reduce the flow cross-sectional area of the gas, which may be disadvantageous.

Therefore, in an embodiment of the present disclosure, the gas discharged from the center opening 154 of the gas outlet 150 may be restricted from flowing straight by the diffusion portion 241 and may be diffused in the radial direction, while the side opening 156 may not overlap with the diffusion portion 241 so that a portion of the gas may flow straight into the first flow path 258, and a remaining portion of the gas may be discharged from the center opening 154 and diffused along the radial direction under an influence of the gas diffused by the diffusion portion 241. The diameter D1 of the diffusion portion 241, the diameter D2 of the center opening 154, and the diameter D3 of the side opening 156 as described above may be variously determined in terms of design.

In one example, referring to FIG. 10, the second flow path 259 may have an inner diameter larger than an outer diameter of the side opening 156 so that the gas introduced through the center opening 154 and the side opening 156 may be diffused and moved.

FIG. 10 shows that an outer diameter D4 of the second flow path 259 is larger than the outer diameter D3 of the side opening 156, which may (or may not) correspond to an outer diameter of the first flow path 258. For example, the outer diameter of the first flow path 258 may be slightly bigger than the outer diameter D3 of the side opening 156 (while an inner diameter of the first flow path 258 may be slightly smaller than an inner diameter of the side opening 156, such that, in an axial direction, the first flow path 258 aligns with and overlaps with the side opening 156). An embodiment of the present disclosure allows the portion of the gas discharged from the side opening 156 to flow straight into the first flow path 258.

However, the outer diameter D4 of the second flow path 259, which may correspond to an inner diameter D4 of the second guide 251, may be at least larger than the outer diameter D3 of the side opening 156 so that t diffusion may be induced. An entirety of the gas discharged from the gas outlet 150, including the gas discharged from the side opening 156, may have a larger flow cross-sectional area. FIG. 10 shows the guide frame 240 in which the second guide 251 has the inner diameter D4 larger than the outer diameter D3 of the side opening 156 to induce the diffusion of the entirety of the gas discharged from the gas outlet 150, and in which the second guide 251 is located forwardly of the first guide 246 to secure a space for the gas to flow into the second flow path 259 from the inner surface of the diffusing case 210.

This application is related to co-pending U.S. application Ser. No. 17/077,915 filed on Oct. 22, 2020, Ser. No. 17/077,917 filed on Oct. 22, 2020, Ser. No. 17/077,921 filed on Oct. 22, 2020, Ser. No. 17/077,922 filed on Oct. 22, 2020, Ser. No. 17/077,927 filed on Oct. 22, 2020, Ser. No. 17/077,929 filed on Oct. 22, 2020, Ser. No. 17/085,385 filed on Oct. 30 2020, and Ser. No. 17/077,119 filed on Oct. 22, 2020, the entire contents of which are incorporated by reference herein.

Although a specific embodiment of the present disclosure has been illustrated and described above, those of ordinary skill in the art to which the present disclosure pertains will appreciate that various modifications are possible within the limits without departing from the technical spirit of the present disclosure provided by the following claims.

Embodiments of the present disclosure may provide a diffuser and a hair dryer including a diffuser capable of efficiently improving gas flow and providing the improved gas flow to a user. In addition, embodiments of the present disclosure may provide a diffuser and a hair dryer including the same in which structural stability may be effectively improved and manufacturing and assembly processes may be efficiently improved.

A diffuser according to an embodiment of the present disclosure may be coupled to a main body of a hair dryer to disperse gas provided from the main body and discharge the gas to outside. Flow dispersion of the gas may be achieved through a guide frame. The guide frame may be provided inside the diffuser and guide the flow of the gas provided from the main body to be dispersed.

An entirety of a gas outlet provided on the main body may be in a shape of a hole. The gas may be respectively discharged from a center portion or opening and a side portion or opening spaced apart from the center portion.

The diffuser according to an embodiment of the present disclosure may include the guide frame therein. The guide frame may effectively diffuse the gas and guide the flow of the gas even when the gas is discharged from the entirety of the gas outlet or the separate gas flows are respectively provided from the center portion and the side portion. The guide frame may be provided to diffuse the gas discharged from the gas outlet and may define a first flow path and a second flow path using a first guide and a second guide.

The gas provided from the gas outlet may flow through the first flow path and the second flow path and may be discharged forwardly of the diffuser. The gas discharged from the gas outlet may be diffused in the process of flowing into the first flow path and the second flow path, so that gas with improved uniformity may be discharged forwardly of the diffuser in a larger flow area.

The diffuser according to an embodiment of the present disclosure as described above may include a diffusing case and the guide frame. The diffusing case may have a rear side removably coupled to the main body of the hair dryer. Gas discharged from the main body may be introduced into the diffusing case through a gas inlet hole defined at the rear side. The gas introduced into the diffusing case may be discharged from a front side of the diffusing case. An inner diameter of the diffusing case increases forwardly.

The guide frame may be provided inside the diffusing case to guide flow of the gas introduced through the gas inlet hole. The guide frame may include a diffusion portion, and the diffusion portion may be provided to face the gas inlet hole to diffuse the gas introduced through the gas inlet hole.

In an embodiment of the present disclosure, the gas may flow inside the diffusing case where the inner diameter increases forwardly and diffuses in a radial direction of the diffusing case so that the gas may be provided to a user with a wider flow cross-sectional area. In addition, the guide frame may include the diffusion portion, and the diffusion portion may be provided to diffuse the gas introduced through the gas inlet hole in the radial direction so that the gas introduced into the diffusing case may be effectively diffused in the radial direction, thereby providing the gas with the uniform and wide flow cross-sectional area to the user.

The diffusion portion may have a diffusion protrusion protruding toward the gas inlet hole on a rear surface of the diffusion portion facing the gas inlet hole. A protrusion height of the diffusion protrusion may increase centerwardly. The guide frame may have a ring shape and include a plurality of gas flow paths having the diffusion portion located at a center of the plurality of gas flow paths, and the plurality of gas flow paths may be arranged to have different diameters to divide gas flows respectively in the plurality of gas flow paths from each other.

At least one of the plurality of gas flow paths may have a diameter larger than a diameter of the gas inlet hole. The plurality of gas flow paths may include a first flow path and a second flow path. The guide frame may further include a first guide formed in a ring shape to have the diffusion portion located at a center of the first guide. The first flow path may be defined between the first guide and the diffusion portion, and a second guide may be formed in a ring shape to have the diffusion portion and the first guide at a center of the second guide. The second flow path may be defined between the second guide and the diffusion portion. The gas introduced through the gas inlet hole may flow to the front side of the diffusing case through the first flow path and the second flow path.

The second flow path may have an outer diameter larger than a diameter of the gas inlet hole so that the gas introduced through the gas inlet hole may diffuse and flow. The first guide may be located forwardly of the diffusion portion, and the second guide may be located forwardly of the first guide.

The diffuser may further include a light irradiator provided on front surfaces of the diffusion portion, the first guide, and the second guide to irradiate light toward the front side of the diffusing case. The guide frame may further include a guide connector extending along a radial direction of the guide frame to connect the diffusion portion, the first guide, and the second guide to each other.

The diffuser may further include a discharge cover provided at the front side of the diffusing case. The discharge cover may include a gas discharge hole to discharge the gas introduced into the diffusing case to outside. The discharge cover may include a massage protrusion protruding forward.

A hair dryer according to an embodiment of the present disclosure includes a main body, a handle, and a diffuser. The main body includes a gas outlet for discharging gas therethrough, the handle extends from the main body, and a diffuser may be removably coupled to the main body to introduce the gas discharged from the gas outlet therein and discharge the gas introduced therein to outside.

The diffuser may include a diffusing case having a rear side removably coupled to the main body. The gas discharged from the gas outlet may be introduced into the diffusing case through a gas inlet hole defined at the rear side. The gas introduced into the diffusing case may be discharged from a front side of the diffusing case. An inner diameter of the diffusing case may increase forwardly, and a guide frame provided inside the diffusing case may guide flow of the gas introduced through the gas inlet hole.

The guide frame may include a diffusion portion provided to face the gas inlet hole to diffuse the gas introduced through the gas inlet hole. The gas outlet may include a center portion to discharge the gas therethrough, and a side portion having a ring shape and surrounding the center portion. The gas is discharged through the side portion along with the center portion. The diffusion portion may be provided to face the center portion and have a diameter larger than a diameter of the center portion to diffuse the gas introduced from the center portion.

A diameter of the gas inlet hole may be equal to or larger than a diameter of the side portion. The gas discharged from the center portion and the side portion may flow into the diffusing case.

The guide frame may further include a first guide formed in a ring shape to have the diffusion portion located at a center of the first guide. A first flow path to flow or move the gas therethrough may be defined between the first guide and the diffusion portion. A second guide may be formed in a ring shape to have the diffusion portion and the first guide at a center of the second guide. A second flow path to flow or move the gas therethrough may be defined between the second guide and the diffusion portion.

The diffusion portion may have a diameter smaller than an inner diameter of the side portion. The side portion may be positioned to face at least a portion of the first flow path in a forward direction. The second flow path may have an inner diameter larger than an outer diameter of the side portion so that the gas introduced through the center portion and the side portion may be diffused and flow.

Embodiments of the present disclosure may provide a diffuser and a hair dryer including the same capable of efficiently improving the gas flow and providing the improved gas flow to the user. In addition, embodiments of the present disclosure may provide a diffuser and a hair dryer including the same in which a structural stability may be effectively improved and manufacturing and assembly processes may be efficiently improved.

Embodiments disclosed herein may be implemented as a diffuser for a hair dryer, comprising a case having a rear side, a front side, and an inlet provided at the rear side. A cross-sectional area of the case may increase from the rear side toward the front side, and the rear side may be configured to be coupled to and removed from a main body of a hair dryer such that fluid discharged from the main body is introduced through the inlet and discharged toward the front side. The case may further include a guide frame provided inside the case to guide a flow of the fluid introduced through the inlet. The guide frame may have a diffusion guide aligning with the inlet and have a shape configured to diffuse fluid introduced from the inlet outward.

A rear surface of the diffusion guide may include a dome protruding toward the inlet. The dome may have a cross-sectional area that decreases from the rear surface toward the inlet.

The guide frame may include a plurality of ring-shaped openings that surround the diffusion guide. The diffusion guide may be provided at a center of the plurality of openings. Wherein the plurality of openings have different diameters so as to divide flows of fluid introduced through the inlet from each other. At least one of the plurality of openings may have a diameter larger than a diameter of the inlet.

The plurality of openings may include a first opening and a second opening. The guide frame may include a first guide formed in a ring shape and surrounding the diffusion guide, the first opening being defined between the first guide and the diffusion guide; and a second guide formed in a ring shape and surrounding the diffusion guide and the first guide, the second opening being defined between the first guide and the second guide.

The second opening may have an outer diameter larger than an outer diameter of the inlet. The first guide may be positioned to be farther forward than the diffusion section, and the second guide may be positioned to be farther forward than the first guide.

A light frame may be provided in front of the guide frame and have a plurality of openings aligning with the plurality of openings of the guide frame so as not to obstruct a flow of fluid. The light frame may have at least one light emitting diode configured to irradiate light toward the front side of the case.

The guide frame may include at least one rib extending along a radial direction of the guide frame to connect the diffusion guide, the first guide, and the second guide to each other.

A cover may be provided at the front side of the case. The cover may include a discharge hole through which fluid introduced into the case is discharged, and at least one bristle protruding forward and configured to massage a scalp.

Embodiments disclosed herein may be implemented as a hair dryer, comprising a main body including an outlet through which fluid is discharged, a handle extending from the main body, and a diffuser. The diffuser may include a case having a front side and a rear side, the rear side configured to be coupled to and removed from the main body, wherein a cross-sectional area of the case increases from the rear side to the front side, an inlet provided at the rear side and configured to align with the outlet when the case is coupled to the main body so that fluid discharged from the outlet is introduced to the inside of the case via the inlet to be discharged from the front side of the case, and a guide frame provided inside the case. The guide frame may have a diffusion guide facing the inlet and configured to diffuse fluid introduced through the inlet in a radial direction of the diffusion guide.

The outlet of the main body may include an inner opening and an outer opening having a ring shape that surrounds the inner opening. The fluid may be discharged through the inner and outer openings. The diffusion guide may have the inner opening and may have a diameter larger than a diameter of the inner opening to diffuse fluid introduced from the inner opening.

A diameter of the inlet may be equal to or greater than a diameter of the outer opening so that fluid discharged from the inner and outer openings of the outlet flows through the inlet into the case.

The guide frame may include an inner ring and an outer ring. The inner ring may surround and be radially spaced apart from the diffusion guide such that the diffuser guide is provided at a center of the first ring. An inner flow path may be defined between the inner ring and the diffusion guide. The outer ring may surround and be radially spaced apart from the inner ring such that the diffuser guide is provided at a center of the outer ring. An outer flow path may be defined between the outer ring and the inner ring. The diameter of the diffusion guide may be less than an inner diameter of the outer opening of the outlet, and the outer opening may be positioned to align with at least a portion of the inner flow path in a front-rear direction.

The outer flow path may have an inner diameter larger than an outer diameter of the outer opening so that fluid introduced through the inner and outer openings is diffused radially outward and forward. A rear of the diffusion guide may be curved to protrude toward the inner opening and may have a curvature configured to diffuse fluid introduced from the inner opening radially outward.

A guide cone may be provided inside of the inner opening, a diameter of the guide cone decreasing from a rear to a front. The diameter of the guide cone may be less than a diameter of the inner opening to define a ring-shaped space therebetween.

Embodiments disclosed herein may be implemented as a diffuser configured to be coupled to and removed from a hair dryer, comprising an outer shell having concave shape defining a cavity that is configured to surround at least a portion of a human head, an inlet configured to align with an outlet of a hair dryer, a flange surrounding the inlet, the flange having a coupling structure configured to coupled to and be removed from an end of the hair dryer defining the outlet, and a guide frame provided inside of the outer shell and configured to align with the inlet. The guide frame may include a curved surface at a side of the guide frame facing the inlet, the curved surface configured to align with a center of the inlet, a first slot surrounding the curved surface, and a second slot spaced apart from and surrounding the first slot, the second slot being positioned closer to an outer edge of the guide frame than a center of the guide frame such that fluid flowing through the inlet is diffused outward from the curved surface to flow through the first and second slots. The center of the guide frame may be closer to the inlet than the outer edge of the guide frame.

An inner shell may be configured to be provided within the outer shell and have a curvature configured to surround at least a portion of the human head. The guide frame may be provided between the inner shell and the outer shell, a plurality of openings may be provided in the inner shell through which fluid passing through the first and second slots is discharged, and a plurality of massage protrusions may protruding from the inner shell away from the inlet.

A circuit board may have a center board configured to align with the curved surface of the guide frame and the center of the inlet, a first opening spaced apart from and surrounding the center board and aligning with the first slot, a second opening spaced apart from and surrounding the first opening and aligning with the second slot, the second opening being positioned closer to an outer edge of the circuit board than a center of the circuit board such that fluid flowing through the first and second slots flows through the first and second openings, respectively; and a plurality of light emitting devices provided on the circuit board and configured to emit light away from the inlet. The center of the circuit board may be closer to the inlet than the outer edge of the circuit board. The flange may include a magnet configured to be magnetically attracted to the hair dryer.

It will be understood that when a component is referred to as being "connected with" another component, the component may be directly connected with the other component or intervening components may also be present. In contrast, it will be understood that when a component is referred to as being "directly connected with" another component in this specification, there are no intervening components present. Further, in this specification, the terminology used herein is for the purpose of describing a specific embodiment only and is not intended to be limiting of the present disclosure. In this specification, the singular forms "a" and "an" are intended to include the plural forms as well, unless the context clearly indicates otherwise.

In this specification, it will be further understood that the terms "comprises", "comprising", "includes", and "including" specify the presence of the certain features, numbers, steps, operations, elements, and parts or combinations thereof, but do not preclude the presence or addition of one or more other features, numbers, steps, operations, elements, and parts or combinations thereof. Further, in this specification, the term 'and/or' includes a combination of a plurality of listed items or one of the plurality of listed items. In this specification, 'A or B' may include 'A', 'B', or 'both A and B'.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A diffuser for a hair dryer, comprising:

a case having a rear side, a front side, and an inlet provided at the rear side, wherein a cross-sectional area of the case increases from the rear side toward the front side, and the rear side is configured to be coupled to and removed from a main body of a hair dryer such that fluid discharged from the main body is introduced through the inlet and discharged toward the front side;

a guide frame provided inside the case to guide a flow of the fluid introduced through the inlet, the guide frame having a diffusion guide aligning with the inlet and having a shape configured to diffuse fluid introduced from the inlet outward; and a cover provided at the front side of the case, wherein the cover includes:

a discharge hole through which fluid introduced into the case is discharged; and at least one bristle protruding forward and configured to massage a scalp.

2. The diffuser of claim 1, wherein a rear surface of the diffusion guide includes a dome protruding toward the inlet, the dome having a cross-sectional area that decreases from the rear surface toward the inlet.

3. The diffuser of claim 1, wherein the guide frame includes a plurality of ring-shaped openings that surround the diffusion guide, the diffusion guide being provided at a center of the plurality of openings, and wherein the plurality of openings have different diameters so as to divide flows of fluid introduced through the inlet from each other.

4. The diffuser of claim 3, wherein at least one of the plurality of openings has a diameter larger than a diameter of the inlet.

5. The diffuser of claim 3, wherein the plurality of openings include a first opening and a second opening, and the guide frame further includes:

a first guide formed in a ring shape and surrounding the diffusion guide, wherein the first opening is defined between the first guide and the diffusion guide; and a second guide formed in a ring shape and surrounding the diffusion guide and the first guide, wherein the second opening is defined between the first guide and the second guide.

6. The diffuser of claim 5, wherein the second opening has an outer diameter larger than an outer diameter of the inlet.

7. The diffuser of claim 5, wherein the first guide is positioned to be farther forward than the diffusion section, and the second guide is positioned to be farther forward than the first guide.

8. The diffuser of claim 7, further comprising:

a light frame provided in front of the guide frame and having a plurality of openings aligning with the plurality of openings of the guide frame so as not to obstruct a flow of fluid, the light frame having at least one light emitting diode configured to irradiate light toward the front side of the case.

9. The diffuser of claim 5, wherein the guide frame further includes at least one rib extending along a radial direction of the guide frame to connect the diffusion guide, the first guide, and the second guide to each other.

10. A hair dryer including the diffuser of claim 1.

11. A hair dryer, comprising:

a main body including an outlet through which fluid is discharged;

a handle extending from the main body; and a diffuser including:

a case having a front side and a rear side, the rear side configured to be coupled to and removed from the main body, wherein a cross-sectional area of the case increases from the rear side to the front side, an inlet provided at the rear side and configured to align with the outlet when the case is coupled to the main body so that fluid discharged from the outlet is introduced to an inside of the case via the inlet to be discharged from the front side of the case;

a guide frame provided inside the case, the guide frame having a diffusion guide facing the inlet and configured to diffuse fluid introduced through the inlet in a radial direction of the diffusion guide; and a cover provided at the front side of the case, wherein the cover includes:

a discharge hole through which fluid introduced into the case is discharged; and at least one bristle protruding forward and configured to massage a scalp.

12. The hair dryer of claim 11, wherein the outlet of the main body includes:

an inner opening; and an outer opening having a ring shape that surrounds the inner opening, wherein the fluid is discharged through the inner and outer openings, wherein the diffusion guide faces the inner opening and has a diameter larger than a diameter of the inner opening to diffuse fluid introduced from the inner opening.

13. The hair dryer of claim 12, wherein a diameter of the inlet is equal to or greater than a diameter of the outer opening so that fluid discharged from the inner and outer openings of the outlet flows through the inlet into the case.

14. The hair dryer of claim 13, wherein the guide frame further includes:

an inner ring surrounding and radially spaced apart from the diffusion guide such that the diffuser guide is provided at a center of the first ring, wherein an inner flow path is defined between the inner ring and the diffusion guide; and an outer ring surrounding and radially spaced apart from the inner ring such that the diffusion guide is provided at a center of the outer ring, wherein an outer flow path is defined between the outer ring and the inner ring, wherein:

the diameter of the diffusion guide is less than an inner diameter of the outer opening of the outlet, and the outer opening is positioned to align with at least a portion of the inner flow path in a front-rear direction.

15. The hair dryer of claim 14, wherein the outer flow path has an inner diameter larger than an outer diameter of the outer opening so that fluid introduced through the inner and outer openings is diffused radially outward and forward.

16. The hair dryer of claim 12, wherein a rear of the diffusion guide is curved to protrude toward the inner opening and has a curvature configured to diffuse fluid introduced from the inner opening radially outward.

17. The hair dryer of claim 12, further comprising a guide cone provided inside of the inner opening, a diameter of the guide cone decreasing from a rear to a front, wherein the diameter of the guide cone is less than a diameter of the inner opening to define a ring-shaped space therebetween.

18. A diffuser configured to be coupled to and removed from a hair dryer, comprising:

an outer shell having concave shape defining a cavity that is configured to surround at least a portion of a human head;

an inlet configured to align with an outlet of a hair dryer;

a flange surrounding the inlet, the flange having a coupling structure configured to coupled to and be removed from an end of the hair dryer defining the outlet; and a guide frame provided inside of the outer shell and configured to align with the inlet, the guide frame having:

a curved surface at a side of the guide frame facing the inlet, the curved surface configured to align with a center of the inlet, a first slot surrounding the curved surface, and a second slot spaced apart from and surrounding the first slot, the second slot being positioned closer to an outer edge of the guide frame than a center of the guide frame such that fluid flowing through the inlet is diffused outward from the curved surface to flow through the first and second slots, wherein the center of the guide frame is closer to the inlet than the outer edge of the guide frame.

19. The diffuser of claim 18, further comprising:

an inner shell configured to be provided within the outer shell and having a curvature configured to surround at least a portion of the human head, wherein the guide frame is provided between the inner shell and the outer shell;

a plurality of openings provided in the inner shell through which fluid passing through the first and second slots is discharged; and a plurality of massage protrusions protruding from the inner shell away from the inlet.

20. The diffuser of claim 18, further comprising a circuit board having:

a center board configured to align with the curved surface of the guide frame and the center of the inlet, a first opening spaced apart from and surrounding the center board and aligning with the first slot, a second opening spaced apart from and surrounding the first opening and aligning with the second slot, the second opening being positioned closer to an outer edge of the circuit board than a center of the circuit board such that fluid flowing through the first and second slots flows through the first and second openings, respectively; and a plurality of light emitting devices provided on the circuit board and configured to emit light away from the inlet, wherein the center of the circuit board is closer to the inlet than the outer edge of the circuit board.

21. The diffuser of claim 18, wherein the flange includes a magnet configured to be magnetically attracted to the hair dryer.

* * * * *